United States Patent [19]

Kageyama

[11] 4,423,355

[45] Dec. 27, 1983

[54] ION GENERATING APPARATUS

[75] Inventor: Katsuhiro Kageyama, Yokosuka, Japan

[73] Assignee: Tokyo Shibaura Denki Kabushiki Kaisha, Kanagawa, Japan

[21] Appl. No.: 245,534

[22] Filed: Mar. 19, 1981

[30] Foreign Application Priority Data

| | | | |
|---|---|---|---|
| Mar. 26, 1980 | [JP] | Japan | 55-37572 |
| Jul. 25, 1980 | [JP] | Japan | 55-102216 |
| Jul. 25, 1980 | [JP] | Japan | 55-102217 |
| Oct. 9, 1980 | [JP] | Japan | 55-141364 |
| Oct. 28, 1980 | [JP] | Japan | 55-151016 |
| Nov. 19, 1980 | [JP] | Japan | 55-162856 |
| Nov. 19, 1980 | [JP] | Japan | 55-162857 |

[51] Int. Cl.[3] ..... H01J 33/00

[52] U.S. Cl. ..... 315/111.81; 313/362.1; 313/231.41; 315/111.91; 250/426

[58] Field of Search ..... 315/111.41, 111.81, 315/111.91, 338, 344; 313/161, 162, 230, 231.3, 231.4, 362.1, 363.1; 250/423 R, 426

[56] References Cited

U.S. PATENT DOCUMENTS

| | | | |
|---|---|---|---|
| 3,949,230 | 4/1976 | Bach | 250/423 |
| 3,955,118 | 5/1976 | Flemming | 315/111.81 |

*Primary Examiner*—Eugene R. La Roche

*Attorney, Agent, or Firm*—Stevens, Davis, Miller & Mosher

[57] ABSTRACT

An ion generating apparatus comprises a cylindrical vacuum vessel within which an anode and cathodes are disposed. The anode is provided with an inner tubular hollow portion and the cathodes are located near both end openings of the anode. The apparatus further comprises means for applying a voltage between the anode and the cathodes, a magnetic field generator, means for supplying operating gas into the hollow portion of the anode, and an evacuating device. At least one of the cathodes is provided with a through hole at the central portion thereof. The apparatus further comprises a control electrode stretched in the hollow portion in parallel with but apart from the central axis of the hollow portion.

30 Claims, 47 Drawing Figures

FIG. 3
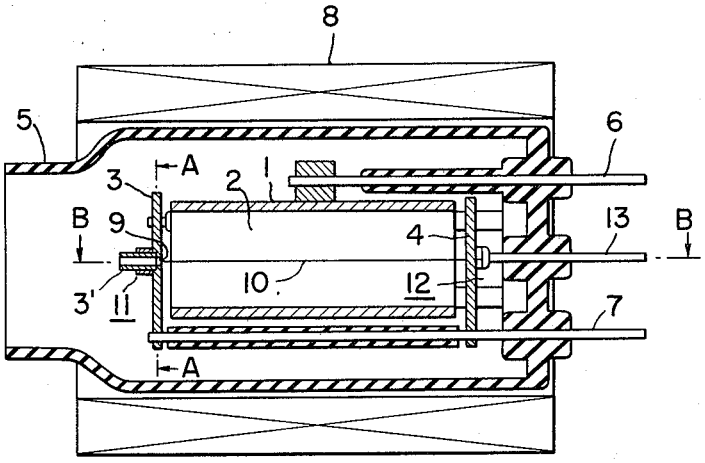
FIG. 5
FIG. 4
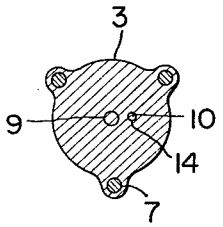
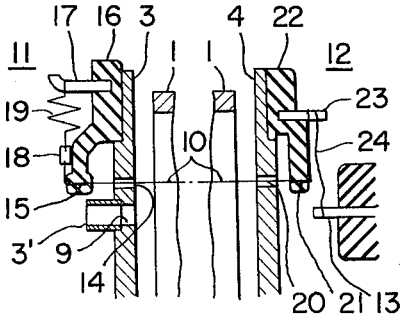

ION GENERATING APPARATUS

BACKGROUND OF THE INVENTION

This invention relates to ion generating apparatus comprising a cross field discharge device utilizing a PIG (Penning Ion Gauge) type discharge.

Recently, in surface wording (ion plating, ion implantation, etching, etc.) and surface analysis of semiconductors and metals or in a field of nuclear fusion and nuclear physics, various kinds of ion generating apparatus have been widely used. In these apparatus are generally included duoplasmatron-type, duopigatron-type and the like type ion generating apparatus in which a plasma is created and ions generated are extracted. However, these apparatus commonly possess a disadvantage of an adverse gas efficiency, which results in the entrainment of a large amount of neutral gaseous molecules in an ion beam extracted from the ion generating apparatus and an electric breakdown is easily caused at an ion accelerating portion. For this reason, it is difficult to obtain high ion beam energy and the plasma is created about the ion beam extracted. Moreover, electrons are accelerated at the ion acclerating portion towards an ion generating source in opposite direction of the ion flow and collide with an electrode. In addition, electrons increase in their numbers on the way towards the electrode by ionization of the gas molecules flown from the ion source, thus rapidly increasing the temperature of the electrode, which results in breakage of the electrode limiting its long time use. A further disadvantage of the prior type ion generating apparatus (ion source) resides in the short life time of a hot cathode provided for the apparatus to supply electrons.

An improved PIG type ion generating apparatus provided with a cold cathode and having a good gas efficiency has been proposed for obviating the disadvantages described above.

FIG. 1 shows a typical ion generating apparatus of this type, which comprises a vacuum vessel or vacuum envelope 5, a cylindrical anode 1 located in the vessel 5, a pair of cathodes 3 and 4 located in the vessel 5 at portions near both end openings of the anode 1 so as to cover the inner tubular, usually cylindrical, hollow portion 2 of the anode 1 with small gaps, lead wires 6 and 7 electrically connected to the anode 1 and cathodes 3 and 4 respectively, and a magnetic field generating device 8 surrounding the vacuum vessel 5 for applying a magnetic axially of the anode. The annular cathode 3 is disposed on the side of extracting ions (leftside as viewed in FIG. 1) of the anode 1 and is provided with a central through hole 9 communicating with the hollow portion 2 of the anode 1. The other cathode 4 is disposed on the rightside of the anode and the both cathodes 3 and 4 are electrically connected so as to have a common potential. The anode 1 is connected to a d.c. power source 27 and the cathodes are grounded through a current measuring device 25 which measures cathode current Ik.

The opened end of the vacuum vessel 5 is connected to an evacuating device provided with exhausting means provided for a surface analyzer, for example, not shown, and the interiors of the surface analyzer and the vacuum vessel 5 are preliminarily exhausted to maintain a desired degree of vacuum in the analyzer. The evacuating device is well known itself by those skilled in the art, for example, in "Technical Information" from Institute of Plasma Physics, Nagoya University, Japan, October, 1979. In the use of an ion generating apparatus described above, a desired gas, such as He gas, is admitted from a gas source through the evacuating device into the vacuum vessel 5 to establish a gas discharge in the inner hollow portion 2 of the anode 1 thereby generating ions. The generated ions are ejected into the surface analyzer through the hole 9 to heat analyze the surface of a material to be dealt with. Although the operating condition of the ion genrating apparatus can be selected in accordance with the use thereof, one example will be shown as follows. The density of gas charged in vacuum vessel 5 is $1\times10^{17}\,m^{-3}$; the radius of hollow portion 2 is 7.5 mm; the interelectrode voltage is 5 KV; and the intensity (strength) of magnetic field is 0.15 T (tesla), and ions are ejected in an arrowed direction.

According to the prior art ion generating apparatus of the type described above in conjunction with FIG. 1, ions can be extracted through a hole provided for a cathode by utilizing such a feature as that the ions created by the PIG type discharge collectively collide with the surface of the cathode. Thus, an ion generating apparatus provided with cold cathodes and having a high gas efficiency can be produced. However, as stated in (1) J. C. Helmer and R. L. Jensen's paper entitled "Electrical Characteristics of a Penning Discharge", Proc, IRE, 49(61), 1920 and (2) W. Knaner's paper entitled "Mechanism of the Penning Discharge at Low Pressures", J. Appl. Phys. 33(62) 2093, disadvantages of the apparatus of this type reside in that kinetic energy of the ion beam is distributed in a wide range and it is very difficult to construct the beam line so as to improve the focusing and the parallelism of the ion beam.

In another point of view, the ion generating apparatus according to this invention includes heavy ion generating apparatus in which a heavy ion generation material is disposed on one of the cathodes of the apparatus.

Well known ion generating apparatus includes electron bombardment type, PIG type, and duoplasmatron type heavy ion generating apparatus, in which ions of a material in solid state at a room temperature can be generated.

However, the electron bombardment type apparatus requires a vapour generating furnace for generating vapour of a desired material and the use of such furnace often contaminates the interior of the ion generating apparatus and makes worse the operability thereof. The duoplasmatron type apparatus requires large electric power for forming plasma and a hot cathode or a hollow cathode, which makes worse the operability of the apparatus. The PIG type apparatus utilizing sputtering phenomenon has the advantage that many kinds of heavy ions are generated without using a high temperature vapour generating furnace, but it also requires a large electric power and it is difficult to suppress the temperature rise due to the use of the large electric power.

Although there have been porposed other type ion generating apparatus utilizing sputtering and having cathodes provided with through holes, which have simple construction and consume less electric power, they are not suitable for actual use because of considerable small current of ions taken out in comparison with the other type apparatus described hereinbefore.

In still another point of view, the ion generating apparatus include apparatus each having cathodes covering the end openings of an anode and provided with through holes, respectively. However, when these apparatus are used under the same conditions as those described with respect to the apparatus shown in FIG. 1, discharge state, e.g. discharge current and space voltage are unstable and good operability of the apparatus cannot be obtained.

SUMMARY OF THE INVENTION

Accordingly, an object of this invention is to obviate defects of prior art ion generating apparatus.

Another object of this invention is to provide ion generating apparatus which utilizes a cross field discharge device which is provided with a control electrode in its cross field discharge area for improving kinetic energy distribution of an ion beam extracted and operability of the apparatus.

Still another object of this invention is to provide a heavy ion generating apparatus with is provided with a control electrode in its cross field discharge area for increasing ion current and controlling kinetic energy distribution of a heavy ion beam extracted and operability of the apparatus.

Still another object of this invention is to provide ion generating apparatus provided with a plurality of control electrodes disposed within a cross field discharge area.

According to this invention there is provided an ion generating apparatus of the type comprising a cylindrical vacuum vessel, an anode disposed in the vacuum vessel and provided with a tubular inner hollow portion, a pair of cathodes disposed in the vacuum vessel near both end openings, means for applying a voltage between the anode and cathodes to creat an electric field in the hollow portion, a device for creating a magnetic field in the hollow portion in a direction parallel to a central axis of the hollow portion, means for supplying operating gas into the hollow portion to establish a cross field discharge, and an evacuating device for creating a predetermined vacuum condition in the vacuum vessel, at least one of the cathodes being provided with a through hole at a central portion thereof, and the apparatus further comprises a control electrode stretched in the hollow portion in parallel spaced relation with respect to the central axis of the hollow portion.

BRIEF DESCRIPTION OF THE DRAWINGS

In the accompanying drawings

FIG. 3 shows a longitudinal section of the main part of the ion generating apparatus shwn in FIG. 2;

FIG. 4 is a cross sectional view of a cathode taken along the line A-A shown in FIG. 3;

FIG. 5 is a cross sectional view showing supporting members secured to the cathodes taken along the line B-B shown in FIG. 3;

DESCRIPTION OF THE PREFERRED EMBODIMENTS

Figure 1:
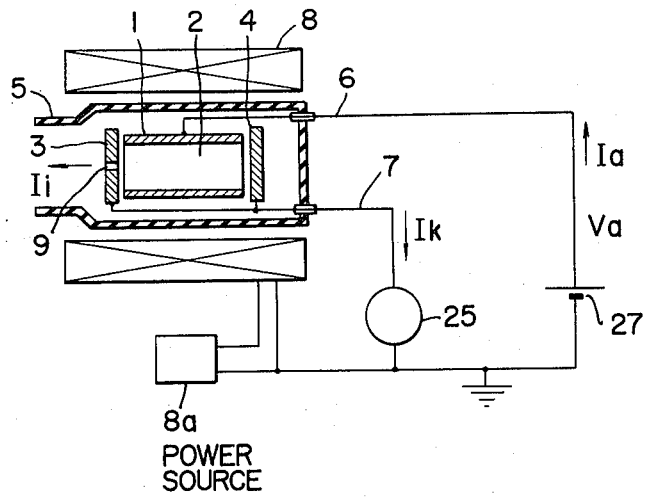
FIG. 1 PRIOR ART
FIG. 1 shows a schematic view of a PIG type ion generating apparatus of prior art.
Figure 2:
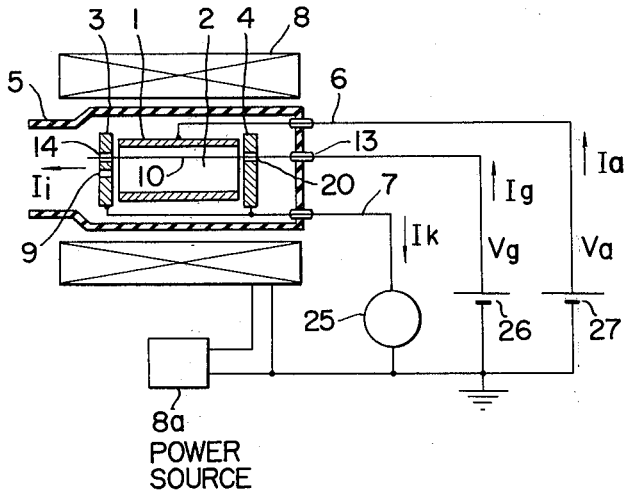
FIG. 2 shows a schematic view of an embodiment of an ion generating apparatus according to this invention.

FIG. 2 is a schematic view of one typical embodiment of this invention, in which like reference numerals applied to elements shown in FIG. 1 are also applied to corresponding one shown in FIG. 2 and descriptions relating to the corresponding elements will not be made.

In an ion generating apparatus shown in FIG. 2, a fine (wire like) control electrode 10 is additionally provided for the apparatus shown in FIG. 1 in the longitudinal direction of the anode electrode 1 and in parallel with the magnetic field formed by the magnetic field generator 8 such as an electromagnet but apart from the central axis of the cylindrical hollow portion 2.

A desired voltage $V_g$ can be applied to the control electrode 10 by a d.c. power source 26 to pass a current $I_g$. To the anode 1 is applied a voltage $V_a$ by a d.c. power source 27 disposed between the anode 1 and the ground and a current $I_a$ passes therethrough. Cathode current $I_k$ passing through the cathodes 3 and 4 grounded can be measured by the current measuring device 25.

The ions generated is are extracted through the hole 9 as an ion beam and an ion current $I_i$ generated at this time has the relationship $I_i+I_k=I_g+I_a$. While, voltages $V_g$ and $V_a$ may be selected so as to satisfy a relation "100 V$<V_g<V_a-200$ V" and, preferably, "600 V$<V_g<V_a-500$ V$=4500$ V".

Referring to FIG. 3, lead wires 6, 7 and 13 are embedded in the base of the vacuum vessel 5 and these lead wires also act as supporting members of the anode and cathode electrodes. The lead wire 6 is electrically and mechanically connected to the anode 1 and the lead wire 7 is connected to the cathodes 3 and 4.

As shown in FIG. 4, the cathode 3 is provided with a through hole 9 at the central potion thereof through which the generated ions pass and with a through hole 14, apart from the hole 9, through which the control electrode passes. A hollow cylindrical ion extraction electrode 3' (FIG. 3) may be provided for the cathode 3 so as to align its axis with that of the hole 9 thereby to effectively extract an ion beam through the hole 9, to narrow the width of kinetic energy distribution of the ion beam, and to prevent contamination of the control electrode supporting members.

The lead wire 13 is connected to the control electrode 10 which is supported by supporting members 11 and 12 secured to the cathodes 3 and 4, respectively, as shown in FIG. 5.

In FIG. 5, the fine control electrode 10 made of a metalic material passes through holes 14 and 20 provided for the cathodes 3 and 4 without contacting the same. The hole 14 (or 20) is cylindrical, but it is important to determine the radius thereof in accordance with desired characteristics so as not to be too large for preventing an adverse affect on the discharging or too small for preventing current flow near the hole 14 between the control electrode 10 and the cathode 3.

The supporting member 11 comprises an insulating member 16 provided with a fine hole 15 and secured to the cathode 3, a fixing member 17 secured to the insulating member 16, and a spring 19 having one end engaged with the fixing member 17 and the other end connected to a connection fitting 18, to which the fine control electrode 10 passing through the hole 15 is connected. The spring 19 acts to provide a suitable tension to the electrode 10 to suppress the deflection thereof and absorb the expansion of the electrode 10 due to variation of the temperature thereof. The supporting member 12 is provided for supporting end of the control electrode 10 so as not to contact with the cathode 4 passing through the hole 20 and comprises an insulating member 22 provided with a fine hole 21 and secured to the cathode 4 and a fixing member 23 secured to the insulating member 22. The end of the control electrode 10 passing through the hole 21 is secured to the fixing member 23. A conductor 24 connects the fixing member 23 to the lead wire 13 which is connected to the power source 26.

The characteristics and effects of the embodiment of this invention described above in comparison with those of the prior art apparatus will be described hereinbelow with reference to FIGS. 6*a* through 6*c* and FIGS 7*a* through 7*c*.

FIGS. 6*a* and 6*b* and FIGS. 7*a* and 7*b* show space voltages V at the discharge portion by using cylindrical coordinates (r,Z) having an axis which accords with the axis of the cylindrical hollow portion 2 of the anode 1, and in these figures, Z at the surface of the cathode 3 facing the end of the anode is represented as Z=0, Z at the surface of the cathode 4 facing the other end of the anode is shown as $Z=Z_4$, and Z at the central plane in a longitudinal direction of the anode is shown as $Z=Z_1$. $r_a$ is a radius of the cylindrical hollow portion 2, and $V_a$ is a voltage applied to the anode 1. A voltage applied to the cathode is zero.

Figure 6A:
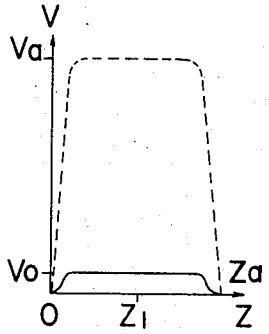
FIGS. 6*a* through 6*c* are graphs showing characteristics of a prior art PIG type ion generating apparatus.
Figure 6B:
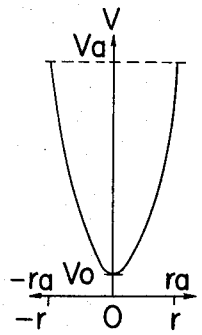
Figure 7A:
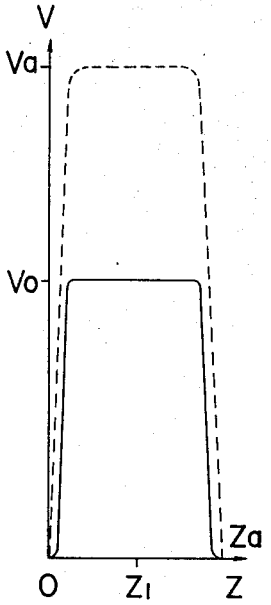
FIGS. 7*a* through 7*g* are graphs showing characteristics of the ion generating apparatus shown in FIG. 2 and other embodiments of this invention.
Figure 7B:
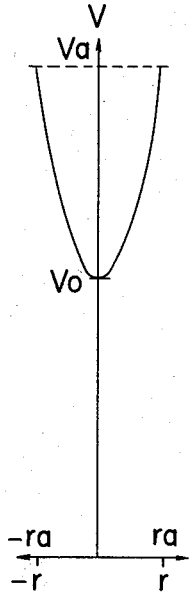

FIG. 6*a* and FIG. 7*a* represent space voltages along the line r=0 and FIG. 6*b* and FIG. 7*b* represent space voltages on the plane $Z=Z_1$.

Characteristics and effects of the prior art apparatus will now be described with reference to FIGS. 6*a* through 6*c*. When the voltage $V_a$ is applied to the anode and no discharge is established, the space voltage near the central portion of the hollow portion 2 is also nearly $V_a$, which is shown by a dotted line. When a discharge is established, the space potential (voltage) largely falls down in comparison with that when no discharge is established because a number of electrons are captured in a space defined by the hollow anode and the cathodes. An electric field is created at the space by space charges due to the captured electrons. The distribution of this space voltage is shown in FIG. 6*a* or FIG. 6*b* by a solid line, in which $V_0$ represents a cathode drop and the value of $V_0$ is considerably smaller than the value of $V_a$ in the PIG type discharge.

Figure 6C:
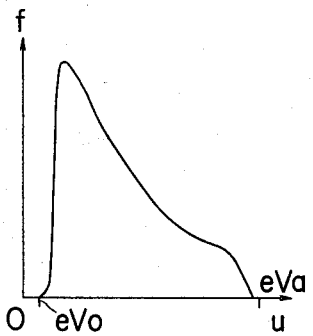
FIG. 6c PRIOR ART

FIG. 6*c* represents the distribution function f of the kinetic energy of ions extracted as an ion beam through the hole 9 of the cathode 3 in FIG. 1, in which the abscissa shows a kinetic energy u and the ordinate the number of ions having energy range between u and u+du extracted for a unit time. Although the ion generating apparatus of this invention is not limited by kinds of ions to be extracted and multiple-charged ions can be dealt with, only single-charged ions are dealt with in this embodiment for the convenience of the descriptions.

Ions are created by ionizing neutral molecules supplied in the discharging portion of the apparatus by the collision of the electrons, and at this time kinetic energy of ions due to the collision is very low because mass ratio between the ions and electrons is large. Since the voltage at the portion where ions are taken out is equal to the voltage of the cathodes (actually zero), the kinetic energy of the ions is represented by $E_k=eV$ (where V is space voltage at a portion where ions are generated and $-e$ is electric large of an electron). Moreover, since the ions are generated at a voltage not smaller than $V_0$ and below $V_a$, the function f (FIG. 6*c*) takes a value, not zero, between a range $eV_0 \leqq u < eV_a$. As can be understood by this range, a severe disadvantage resides in that the space voltage V has a wide range of from $V_0$ to $V_a$ and the kinetic energy is widely distributed.

Figure 7C:
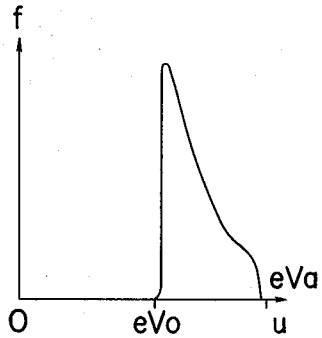

Taking the above description regarding the prior art apparatus into consideration, the characteristics and effects of the apparatus of this invention will be described hereunder in conjunction with FIGS. 7*a* through 7*c* to obtain ions having a narrow energy distribution.

The voltage $V_g$ applied to the control electrode 10 at a certain portion is not to accord with a space voltage $V_g$, in a case where it is assumed that the control electrode does not exist at the certain portion (such as a case shown in FIGS. 6*a* through 6*c*). In a case of $V_g$ $V_{g'}$, electrons drift at a velocity of $\vec{E}\times\vec{B}/|\vec{B}|^2$ (where E is an electric field created by electrons and B a magnetic field) and the electrons collide with the control electrode having a low potential energy and are absorbed thereby. Because of a very high drift velocity, the density of the electrons is rapidly reduced and and the electric field is also rapidly reduced. Since the voltage $V_a$ is applied to the anode from the external source, these reducing phenomena continue during an interval in which the space potential near the control electrode 10 approaches the voltage $V_g$. The density of the electrons further reduces after $V_{g'}$ has reached $V_g$ for the reason that the electrons have a large kinetic energy due to their drifting motion and turning motion about the drift center and thereafter, $V_{g'}$ exceeds $V_g$.

When the voltage $V_{g'}$ greatly exceeds the voltage $V_g$, the potential energy of the control electrode 10 becomes very high, electrons hardly reach the control electrode, and thus the reduction of the density of the electrons due to the collision with the electrode 10 will be stopped. The electron density then increases so as to approach the space voltage distribution in a case of no control electrode, and as a result, $V_{g'}$ reduces and the difference $V_{g'}-V_g$ also reduces. When the difference $V_{g'}-V_g$ comes to a value which is to be determined by the kinetic energy of the electrons, the discharge becomes stable.

Under the stable condition, a current $I_g$ flowing out of the control electrode is very small in comparison with a current $I_a$ flowing out of the anode 1 and the relation $0<I_g/I_a<<1$ will be established. The space voltage can be controlled by the small current $I_g$. The controlled space voltage distribution is hardly distributed by arranging the fire control electrode for the reason that the difference $V_{g'}-V_g$ is usually very small with respect to difference $V_a-V_0$ ($V_0$: the voltage along the central axis of the hollow portion 2.) The axis symmetry of the space voltage distribution is also hardly disturbed and the controlled space voltage is shown by FIGS. *7a* and *7b*.

FIG. *7c* shows a function f representing a kinetic energy distribution of ions extracted through the hole 9 of the cathode 3. The function f takes a value satisfying a relation "$eV_0 \leqq u < eV_a$", not including zero, and is shown by a curve in FIG. *7c*. Under a controlled discharging condition, the minimum value $eV_0$ can be made as large as possible as occasion demands and the difference between the maximum and minimum values, $e(V_a-V_0)$, has to be maintained to a value more than a predetermined value necessary for holding the discharge. By increasing the voltages $V_a$ and $V_0$ as high as possible, the relative value $$\gamma\left(\gamma = \frac{e(V_a - V_0)}{eV_a} = 1 - \frac{V_0}{V_a}\right)$$

regarding the energy range can be made considerably smaller than 1 and on the other hand, this value $\gamma$ is estimated as $\gamma \cong 1$ with a prior art apparatus.

FIGS. 8 through 11 show respectively cross sectional views of the anode of other examples of this invention.

Figure 8:
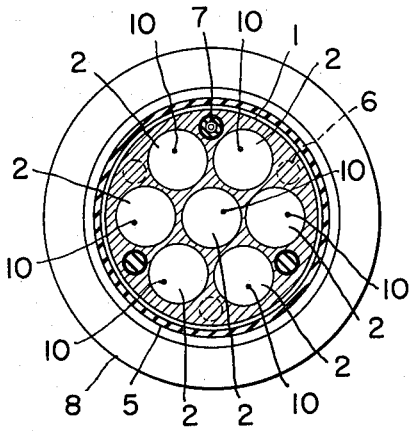
FIGS. 8 through 11 show cross sectional views of examples of the hollow anodes which can be used for the apparatus shown in FIG. 2.
Figure 9:
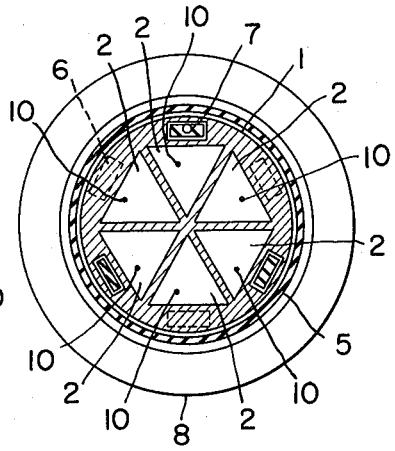
Figure 10:
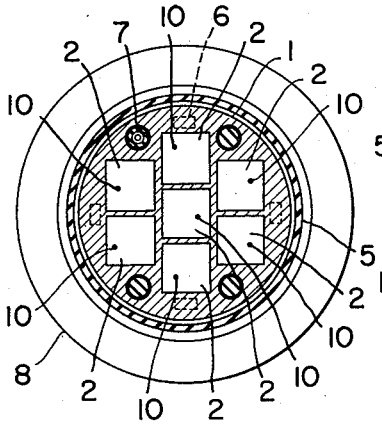
Figure 11:
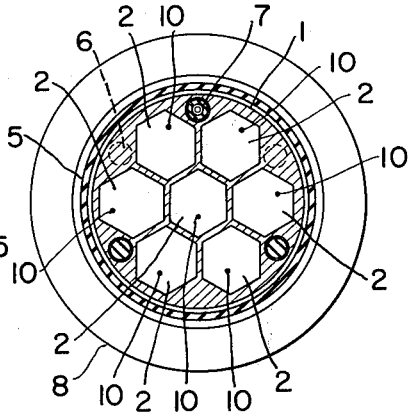

Referring to FIG. 8, within the cylindrical vacuum vessel or envelope 5 is disposed the anode 1 provided with seven cylindrical hollow portions 2 and within these hollow portions 2 are stretched fine control electrodes 10, respectively, each at a position where the axis of the control electrode 10 does not coincide with the central axis of the hollow portion 2. Cathodes, not shown, are provided with through holes through which the fine control electrodes pass. In FIG. 9, the anode 1 is provided with six hollow portions 2 each having a triangular cross section. In FIG. 10, the anode is provided with seven hollow portions each having a square cross-section, and in FIG. 11, the anode is provided with seven hollow portions each having a hexagonal cross section. The fine control electrode 10 is stretched in the axial direction of each hollow portion 2 of the examples shown in FIGS. 9 through 11 at a position where the axis of the electrode 10 is apart from the central axis of the hollow portion 2. Substantially the same descriptions as described hereinbefore regarding the other elements, such as cathodes, supporting members, lead wires, etc. are applicable to the examples shown in FIGS. 8 through 11 except that the cathodes are provided with a plurality of through holes for passing the control electrodes.

Within these examples, the diameter of the anode 1 provided with the hexagonal hollow portions 2 can be most reduced thereby effectively utilizing the magnetic field. The provision of a plurality of hollow portions of the anode makes it possible to increase a current of an ion beam extracted. Although in the examples described above the hollow portions of the anode are formed by drilling a cylindrical metal rod, the anode may be constituted by assembling a plurality of cylindrical or polygonal hollow pipes.

Figure 12:
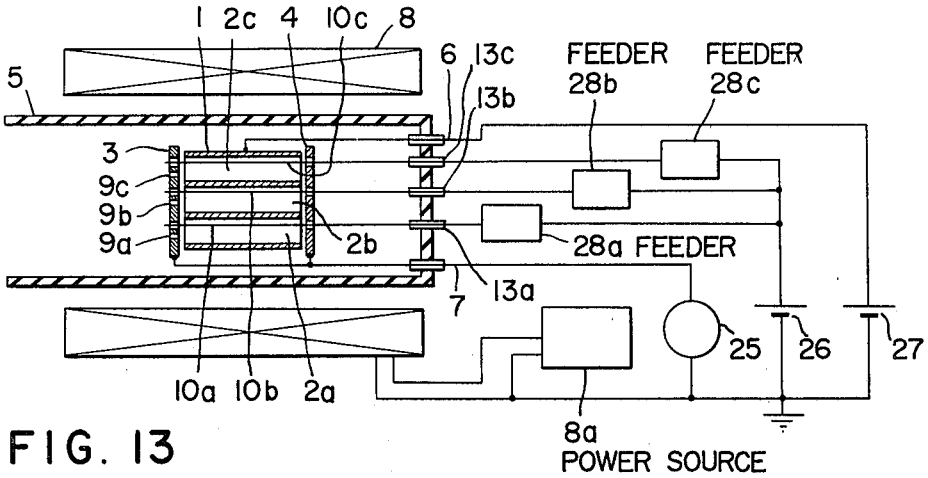
FIG. 12 shows a schematic view of another embodiment of the apparatus in FIG. 2 and a circuit for operating the apparatus.

The operation of the ion generating apparatus having an anode provided with a plurality of hollow portions will be described hereunder in conjunction with FIG. 12, in which the anode 1 is provided with three hollow portions 2 for convenience.

A voltage is applied to the anode 1 by a d.c. power source 27 and the cathodes 3 and 4 cover the opened ends of the anode and are grounded through the current measuring device 25. To the control electodes 10*a* through 10*c* are applied voltages by the d.c. power source 26 through respective feeder members 28*a* through 28*c* each having a feeder circuit element connected to the corresponding control electrode.

Because of a the existence of slight difference between the magnetic fields of the respective hollow portions 2*a*, 2*b* and 2*c* generated by the electromagnet 8, the average kinetic energies of the ion beams are different at the respective through holes 9*a*, 9*b* and 9*c*. Desired ion beams can be obtained by regulating voltages to be applied to the respective control electrodes 10*a*, 10*b* and 10*c*. As a circuit element provided for the feed line, can be used a diode having a voltage drop in a forward direction or a parallel circuit consisting of a resistor and a capacitor can be used in a case where the operating condition of the ion generating apparatus is limited within a certain predetermined range.

In the other example of this invention, instead of the d.c. power source 26, a variable power source can be used for providing a controlled output, and the characteristics of the ion beam can be controlled by a power source having a small capacity. This control of the ion beam taken out may be performed by feedback or programming. Moreover, it is possible to invert the polarity of the output of the power source 26 by connecting the earth side of the power source to the high voltage output of the d.c. power source 27. This example is useful in a case when a large kinetic energy of the ion beam is required.

The above description has been directed to an improved ion generating apparatus according to this invention particularly for obtaining an accelerated ion beam with a high energy, but an appartus can be used to obtain the ion beam with a low and narrow energy distribution by taking into consideration the relationship between the thickness of the control electrode and a position at which the control electrode is to be disposed.

Figure 7D:
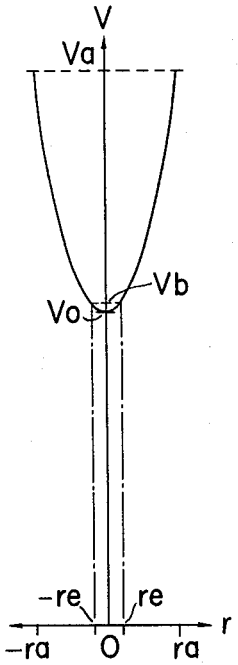
Figure 7F:
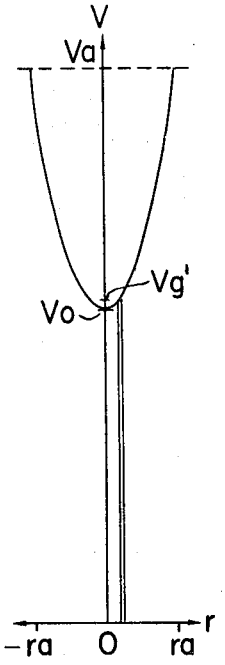
Figure 7E:
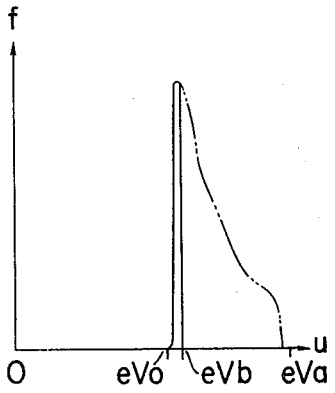

As the thickness of the control electrode becomes large, more ions collide therewith and it presents a problem on design to possibly reduce the thickness. Taking this fact into consideration, in an experiment, a desirable result was obtained by determining the thickness (x) of the control electrode according to a relation $x \leqq k.R/L$ ($k=10^{-3}$ m), in which $x_{(m)}$ designates a radius of the control electrode; $R_{(m)}$ is a distance between the axes of the control electrode and the hollow portion; and $L_{(m)}$ is a distance between the cathodes. As one example in the experiment which obtained good result, a tungsten wire having a radius of 12 μm ($x=1.2\times10^{-5}$ m) was used as the control electrode 10 and the distances R and L were determined as $2.2\times10^{-3}$ m $5\times10^{-2}$ m, respectively. This example satisfies the equation $x \leqq k.R/L$ ($k=10^{-3}$ m). In a case where an ion generating apparatus provided with a control electrode having a thickness (x) satisfying a relation "$x \leqq k.R/L$" is used, the function f regarding a kinetic energy distribution of ions extracted is shown in FIG. 7*e*, from which it can be understood that the range of the kinetic energy distribution is limited to be narrower than that shown in FIG. 7*c*. Thus, an ion beam having a narrow energy range can be obtained by suitably defining the thickness of the control electrode by the provision of an ion extraction electrode 3' described in detail hereinafter.

Figure 13:
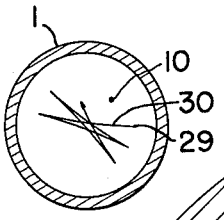
FIG. 13 shows a trajectory of ions in an inner hollow portion of the anode of the apparatus.

FIG. 13 shows a projection of a trajectory of ion motion on a plane normal to the axis of the hollow portion 2 of the anode 1. The ions generated at a point 29 apart from the axis of the hollow portion 2 by the distance $r_1$ start to move from the point 29 on the tragectory 30 shown by a solid line through the electromagnetic field. Since the magnetic field is parallel to the axis of the hollow portion 2 and the component of the electric field in the direction of that axis is zero at the discharging portion, the ions therein move slowly in the axial direction at a speed at a time when the ions are generated. The ions are accelerated when they reach the boundary portion of the discharging area towards the cathodes by the electric field between the boundary portion and the cathodes.

A part of the generated ions collide with the control electrode 10 before moving out of the discharge area. In a case where a considerably large number of ions collide with the control electrode 10, the temperture of the control electrode is excessively raised so that the electrode is violently evaporated and/or sputtered, which damages the electrode. Moreover, a part of the atoms constituting the control electrode is ionized by this sputtering and mixed into the ion beam as impurities. As stated hereinbefore, the use of a fine (wire like) control electrode 10 eliminates possibilities of the ion collision with the electrode 10 and will keep considerably stably the symmetry of the space voltage. However, as a design problem at the manufacture thereof, it is difficult to reduce the thickness of the control electrode below a certain limit, and therefore, in practice, in an experiment, an allowable limit of the thickness x thereof is determined as $x \leqq k.R/L$($k=10^{-3}$ m) and preferably $x<k.R/3L$($k=10^{-3}$ m).

When the ion generating apparatus described above is operated, most of the generated ions arrive at either one of the cathodes and the kinetic energy of the ions is distributed in a range between $eV_0$ and $eV_a$. When the distance $r_1$ at the ion generating point 29 is longer than the radius $r_e$ of the hole 9 (or the electrode 3') and the hole 9 has a sufficiently long longitudinal length, the ions generated at the point 29 collide with the inner surface of the hole 9 and are not mixed with the ion beam to be extracted through the hole 9. Thus, only ions each having the distance $r_1$ smaller than the distance $r_e$ are mixed with the ion beam and the space voltage at the ion generating portion exists in an extremely narrow range between $V_0$ and $V_b$ as shown in FIG. 7*d*. The kinetic energy distribution obtained also exists in a narrow range between $eV_0$ and $eV_b$ as shown in FIG. 7*c*. Although it is required that the higher the ion accelerating voltage, the longer the length of the hole 9, it is desirable in practice that the hole 9 or ion extraction electrode 3' has a length about three times longer than its radius in a case where the ion accelerating voltage is low.

The support member 11 is provided with a conductive portion having a potential different from that of the electrode 3' and the insulating member of the support member 11 is charged when the ion generating apparatus operates, so that non-axis-symmetric electric field is created about the support member, which adversely affects the trajectory of the ion beam when the kinetic energy of the ions is low. The non-axis-symmetric electric field is shielded by the hollow portion of the electrode 3' extending outwardly from the cathode 3 beyond the end of the supporting member 11 as shown in FIG. 3.

In another example of the ion generating apparatus of this invention, a plurality of elemental control electrodes 10 are arranged in the inner hollow portion 2 of the anode 1 as shown in FIGS. 15*a* through 15*d*. In an experiment carried out by using the ion generating apparatus of the type described above, a desirable result was obtained by determining the elements regarding the control electrodes so as to satisfy the following equations.

$$\sum_{n=1}^{m} \frac{N_n X_n}{R_n} \geqq k \cdot \frac{4}{L} \; (k = 10^{-3}\text{m}) \tag{1}$$

$$\sum_{n=1}^{m} N_n = N \tag{2}$$

in which

N: total number of the elemental control electrodes arranged in the hollow portion of the anode, n: an assembly number of the control electrodes which are positioned at portions apart by the same distance from the central axis of the hollow portion of the anode, Nn: total number of the control electrodes belonging to the assembly number n, $R_{n(m)}$: distance between the axis of the hollow portion and the axis of one elemental control electrode belonging to the assembly number n, $X_{n(m)}$: distance obtained by the steps of calculating an average distance of the distances from the central axis of the control electrode to the surface thereof throughout the entire length of each control electrode and then calculating an average distance of the thus obtained average distances of the all control electrodes of the assembly number n, $L_{(m)}$: distance between the surfaces of the cathodes measured along a line parallel to the axis of the hollow portion of the anode, and m: number of the whole assembly numbers.

Figure 15A:
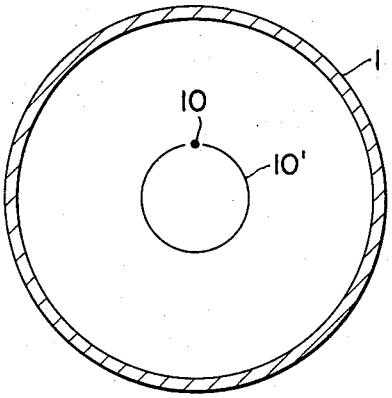
FIGS. 15*a* through 15*d* are cross sectional views of the hollow portions of the anodes showing various examples according to this invention.
Figure 15B:
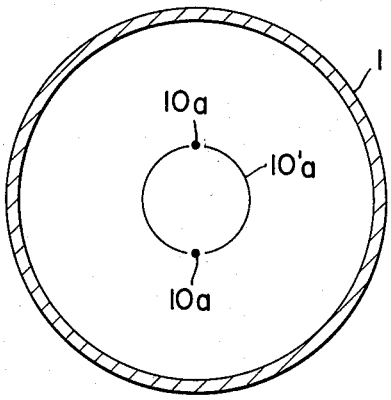
Figure 15C:
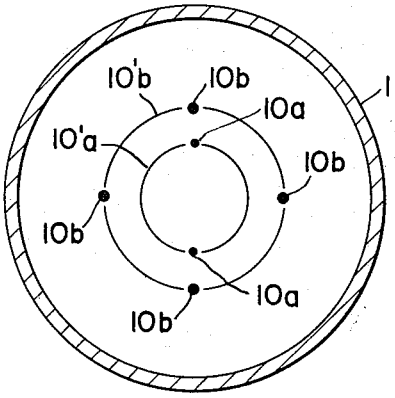
Figure 15D:
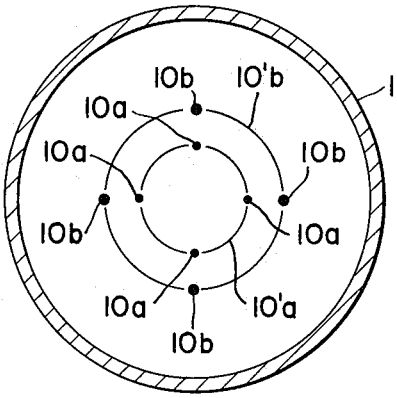

FIG. 15*a* shows a specific example in which N(in the above equation) is 1 and this example has a simple construction and can be manufactured at a low cost. An example shown in FIG. 15*b* is provided with two control electrodes 10*a* on the first separatrix 10'$_a$ and an example in FIG. 15*c* has two control electrodes 10$_a$ on the first separatrix 10'$_a$ and four control electrodes 10$_b$ on the second separatrix 10'$_b$. FIG. 15*d* shows a further example which is provided with four control electrodes 10$_a$ and 10$_b$ on the respective separatrix 10'$_a$ and 10'$_b$. The control electrode 10$_b$ in the example shown in FIG. 15*d* may be constructed as a pipe in which a fluid passes for performing a cooling effect.

Figure 14:
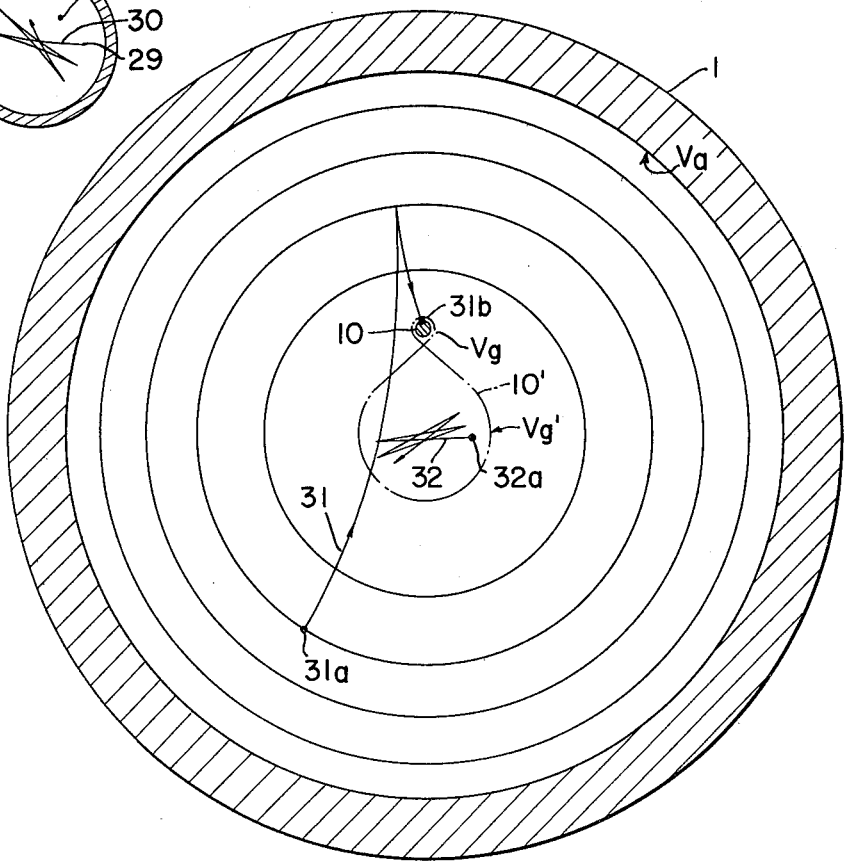
FIG. 14 is a cross sectional view of the hollow portion of the anode for showing potential distribution and trajectories of ions generated.

FIG. 14 is a cross sectional view of the hollow portion of the anode 1 showing a potential distribution of the discharge area and the trajectory of the ion motion. As shown in FIG. 14, substantially circular equipotential lines are formed near the inner surface of the anode 1 about the axis of the hollow portion of the anode 1, but the equipotential line near the control electrode 10 is violently disturbed. The equipotential line extremely near the electrode 10 does not include therein the central axis of the hollow portion and this equipotential line becomes to include the axis as the line gradually departs from the control electrode 10. A boundary of these conditions is called a separatrix 10' of the potential having a voltage $V_{g'}$ and the difference between the voltages $V_{g'}$ and $V_g$ (voltage of the control electrode 10), $V_{g'}-V_g$, is relatively small.

The motion of ions generated outside the separatrix 10' is affected by the force of the electric field directed to the central axis of the anode 1 and the force of the magnetic field normal to the surface of FIG. 14. For example, ions generated at a portion 31*a* move on a trajectory 31. As the ions move slowly in a direction of the magnetic field at the same speed as that at a time when the ions were generated, the ions move along a long trajectory on the cross sectional surface of the anode and almost all ions collide with the control electrode 10 at a portion 31*b* and extinguish before they reach the cathodes 3 and 4. This effect is described hereunder with reference to FIGS. 7*f* and 7*g*.

Figure 7G:
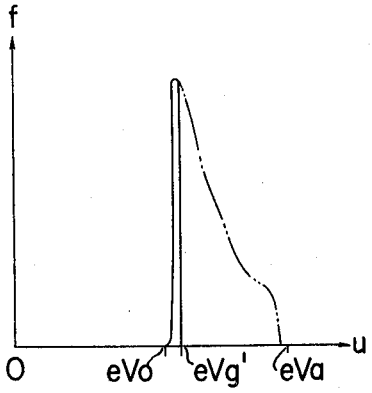

Supposing that generated ions would not collide with the control electrode, the kinetic energy distribution is shown by dot and dash line in FIG. 7*g*, but actually the energy does not exceed $eV_{g'}$, and while, the small number of ions generated within the separatrix near the control electrode can be ignored. The ions generated in the separatrix near the axis of the anode 1, for example, at a portion 32*a*, move along the trajectory 32 (FIG. 14). The ions on the trajectory 32 cannot reach the separatrix 10' having a high potential $V_{g'}$, thus not colliding with the control electrode 10 and the ions moving towards the hole 9 of the cathode 3 are extracted therefrom with no loss and the kinetic energy distribution of the ions extracted has a narrow range between $eV_0$ and $eV_{g'}$ as shown in FIG. 7*g*.

Regarding the embodiments of this invention described hereinbefore, ions each having a large kinetic energy collide with a control electrode and charge into neutral particles. The neutral particles are ionized in a space defined by the anode and the cathodes and thereafter mixed with the ion beam extracted through the hole provided for the cathode, which may result in the lowering of the gas efficiency of the ion generating apparatus of the type described.

Figure 16:
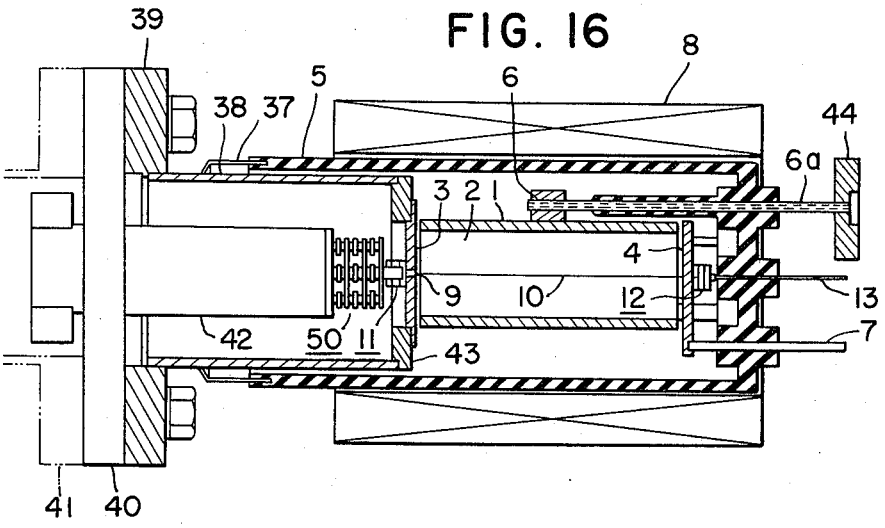
FIG. 16 shows a longitudinal section of another embodiment of the ion generating apparatus according to this invention.

FIG. 16 shows a further embodiment of an ion generating apparatus according to this invention particularly improved for obtaining a high gas efficiency.

Referring to FIG. 16, the vacuum vessel or envelope 5 is air-tightly welded to a cylindrical member 38 made of a non magnetic stainless steel through a cylindrical connection member 37. The cylindrical member 38 is welded to a flange 39, which is air-tightly connected to a flange 41 of a known evacuating device, not shown, for creating vacuum condition in the vacuum vessel 5 through a base flange 40. An electrostatic lens system 50 is secured to a cylindrical member 42 connected to the base flange 40 and supplied with operating voltage through a conductor passing the interior of the member 42. Such electrostatic lens system 50 may also be provided for the ion generating apparatus described hereinbefore.

The cathode 3 is secured to the cylindrical member 38 through a flange 43 and grounded together with the evacuating device through a conductive passage consisting of the flange 43, the member 38 and the flanges 39, 40 and 41. In a case where an ion beam having considerably high energy is desired, an air-tight insulating tube may be disposed between the flange 41 and a grounding electrode of the evacuating device.

According to the ion generating apparatus of the type shown in FIG. 16, a working gas supplied into the inner space of the vacuum vessel 5 is ionized by cross field discharge at the hollow portion 2 of the anode 1, thereby to create ions which are then taken out through the hole 9 of the cathode 3. Ions each having a large kinetic energy collide with the control electrode, lose their charges and are converted into neutral particles. The neutralized particles can be extracted into the evacuating device through the hole 9 which is constructed as a passage having the highest vacuum conductance between the vacuum vessel 5 and the evacuating device and the almost all neutral particles will be ionized on the way where they arrive at the inlet of the hole 9, thus improving the gas efficiency of the ion generating apparatus.

Namely, in FIG. 16, the flange 43 and the member 38 as well as the cathode 3 may be considered as a partition wall which separate a cross field discharge area and exhausting means provided for the evacuating device so that gas flows in the vacuum vessel 5 only through the hole 9 of the cathode 3, thus making the vacuum conductance of the gas flow area of the hole 9 larger than that of the other portion.

The lead wire 6, as a feed line for the anode 1, includes a tube 6*a* penetrating through the wall of the vacuum vessel 5 and the tube 6*a* has one end opened outside the anode 1 and the other end air-tightly welded to the flange 44, which is connected to a device, not shown, for supplying the working gas. In the apparatus shown in FIG. 16, the working gas cannot be transferred to the side of the evacuating device unless it passes through the hole 9 and on the way of this movement before reaching the hole 9 almost all gas is ionized. A part of the generated ions collides with the control electrode 10 and the cathodes 3 and 4, and converts into neutral particles, which are then reionized before reaching the hole 9 of the cathode 3. Thus, the ion beam extracted through the hole 9 contains less neutral particles not ionized, so that the gas efficiency of this ion generating apparatus can be highly improved.

Figure 17:
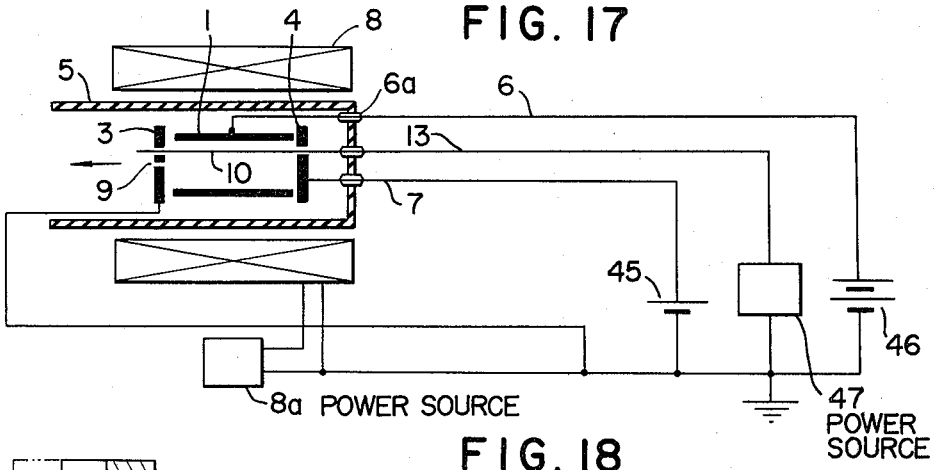
FIG. 17 shows a schematic view of a circuit for operating the apparatus shown in FIG. 16.

With the apparatus shown in FIG. 16, an electric circuit therefor is not limited to a specific one and an alternative example is shown in FIG. 17, in which the magnetic field generator 8 is an air-core coil which is energized by a d.c. power source 8*a*. The cathode 3 is grounded and a positive voltage is applied to the cathode 4 by a d.c. power source 45. To the anode 1 is applied a high voltage by a high d.c. power source 46 and the power source 47 applies a controllable voltage to the control electrode 10 thereby to control the kinetic energy of the ions taken out through the hole 9 in an arrowed direction as shown in FIG. 17.

In order to further improve the operability of the apparatus and exhaust the residual gas at high speed to creat a desirable vacuum condition, the vessel 5 and the evacuating device are preliminarily connected through an evacuation passage having a large vacuum conductance and to the ion generating apparatus is arranged a device for switching the hole 9 with the evacuation passage. Moreover, the gas efficiency can be highly improved by supplying the working gas to either one of the cathode 4, anode 1 or control electrode 10.

In the foregoing description, although there are described embodiments according to this invention in which ions are generated by space discharge, it will be understood that an ion generating apparatus in which a material for generating heavy ions is disposed is also included within the scope of this invention. One embodiment of this type of apparatus will be described hereinafter in conjunction with FIGS. 18 through 20*e*, in which like reference numerals are added to elements corresponding to those shown in the foregoing figures.

Figure 18:
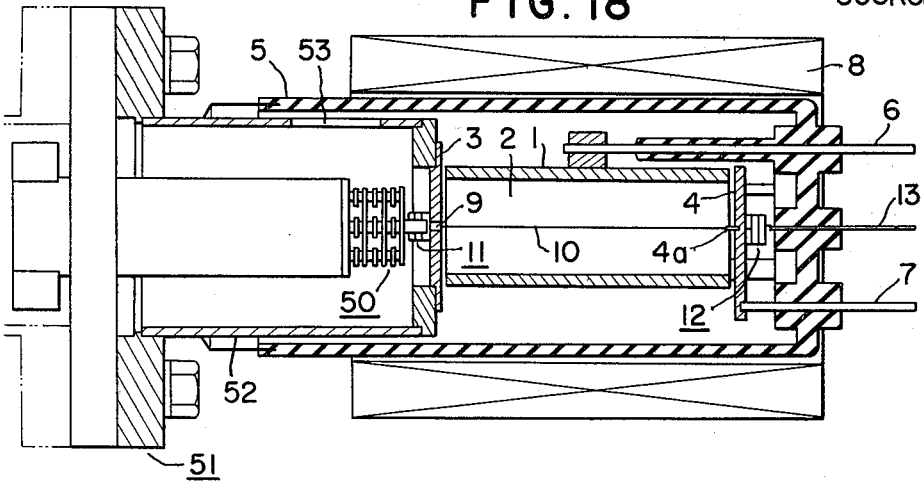
FIG. 18 shows a longitudinal section of still another embodiment of the ion generating apparatus according to this invention in which heavy ions are generated.

In the embodiment illustrated in FIG. 18, a source material 4*a* for heavy ions is firmly secured to the surface of the cathode 4 at the position corresponding to the center of the hole 9 provided for the cathode 3. The material 4*a* can be freely selected, but in this embodiment molybdenum is used. The vacuum vessel 5 is connected to a known evacuating device, not shown, to preliminarily obtain a desired degree of vacuum in the vessel 5 by operating an exhausting device of the evacuating device which also acts to supply a gas in the vacuum vessel 5 suitable for operating the apparatus.

Operating conditions for the apparatus can be selected in accordance with desired characteristics of ions to be generated and one example is as follows: density of working gas in vacuum vessel: $4\times10^{17}$ $m^{-3}$; radius of hollow portion of anode: 7.5 mm; voltage between anode and cathodes: 3 Kv; and strength of magnetic field: 0.15 T (tesla).

A tungsten wire having a radius of 12 $\mu$m is used as a control electrode 10, which is stretched throughout the hollow portion 2 of the anode 1 in parallel with the axis thereof. The distance between the axes of the control electrode and the hollow portion of the anode is predetermined to be 2.2 mm and the distance between the cathodes 3 and 4 is 50 mm. The control electrode 10 is supported by supporting members 11 and 12 which are respectively insulated and held by the cathodes 3 and 4 in substantially the same manner as described before with reference to FIG. 5, and the electrode 10 is connected to a power source to be controllable through a lead wire 13.

A part of the gas introduced into the vacuum vessel 5 is ionized by the discharge in the hollow portion 2 and a part of the generated ions collides with the molybdenum material 4*a*. A part of sputtered molybdenum atoms is ionized at the hollow portion 2 thereby to form molybdenum ions, which are then extracted through the hole 9 as a molybdenum ion beam. The ion beam passing through the electrostatic lens system 50 arranged near or in contact with the through hole 9 is guided through a flange 51 to the evacuating device air-tightly connected to the ion generating apparatus. The ions are then separated into molybdenum ions and other ions by a mass separator disposed in the evacuating device, thus obtaining a highly purified molybdenum ion beam. Although a gas for sputtering the material 4*a* can freely be selected, hydrogen gas is used for this embodiment. The hydrogen gas is admitted into the inside of a cylindrical electroconductive tube 52 through the flange 51 from a hydrogen gas source, not shown, and then supplied into the hollow portion 2 through an opening 53 provided for the tube 52. The electroconductive tube 52 not only supports the cathode 3 but also acts as a feed line to the cathode 3.

Figure 19:
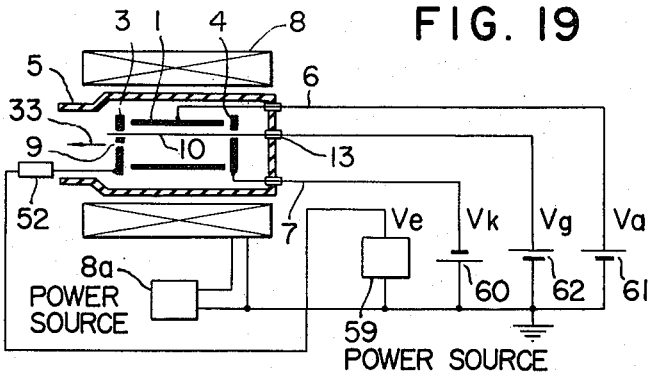
FIG. 19 shows a schematic view of a circuit for operating the apparatus shown in FIG. 18.

FIG. 19 shows one example of a circuit for operating the heavy ion generating apparatus shown in FIG. 18, in which the cathode 3 is grounded through the conductive tube 52 and a current measuring device 59. Voltage $V_e$ of the cathode of this example is zero. A negative voltage $V_k$ is applied to the cathode 4 by a d.c. power source 60 and a high voltage $V_a$ is applied to the anode 1 by a d.c. power source 61. To the control electrode 10 is applied a voltage $V_g$ by a d.c. power source 62.

In order to operate the apparatus, a relation $V_a>V_g>V_k$, $V_e$ must be satisfied. $V_k$ and $V_e$ can be selected in accordance with the characteristics of the apparatus and in this embodiment it is determined to be $V_k<V_e$.

Characteristics and effects of the heavy ion generating apparatus of the type described above will be described hereunder in conjunction with FIGS. 20*a* through 20*e*, in which the abscissa represents a kinetic energy u of hydrogen ions which collide with the molybdenum and the ordinate represents a sputtering ratio S of the sputtered number of atoms of the molybdenum with respect to one hydrogen ion. f represents a function of a kinetic energy distribution of the hydrogen ion in which f du represents the number of hydrogen ions having the kinetic energy higher than u and less than u+du and projected upon the molybdenum material 4*a* for a unit time.

Figure 20A:
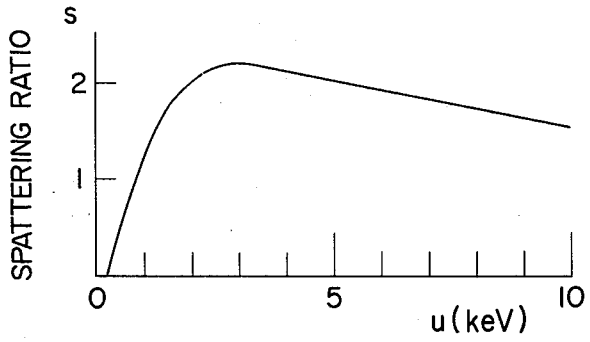
FIGS. 20*a* through 20*e* are graphs showing characteristics and effects of the apparatus shown in FIG. 18 in comparison with a prior art PIG type apparatus.
Figure 20B:
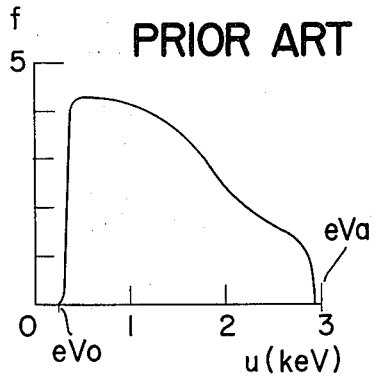
Figure 20C:
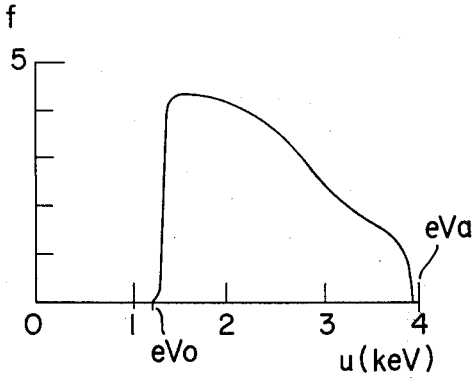

FIG. 20*a* shows a dependence of S on u. FIG. 20*b* shows a dependence of the function f on u in a prior art heavy ion generating apparatus and FIG. 20*c* is a dependence of the function f on u of this invention.

In FIG. 20*b*, in a case where a cathode voltage is zero, an anode voltage is $V_a$, and a charge of a hydrogen ion is e, the function f assumes a zero value in an energy range below zero and in an energy range above $eV_a$. The function is also estimated as "zero" in a range below cathode drop $eV_0$ or above anode drop. Accordingly, the function f assumes a value, not zero, in a range of $eV_0 \leqq u < eV_a$ and a large value at a small value of u and a small value at a large value of u.

Figure 20D:
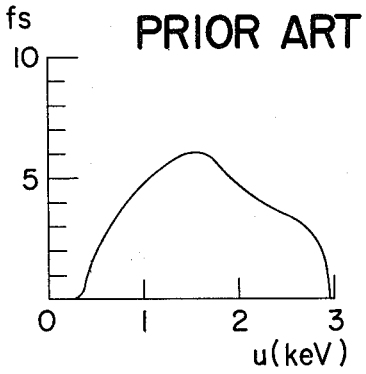

The number (Q) of the molybdenum atoms sputtered by one incident hydrogen ion and ionized for a unit time is shown as $$Q = \int_{eV_0}^{eV_a} f \cdot s\, du$$

and the dependence of an integrand f.s is shown in FIG. 20*d*.

Regarding FIG. 20*c*, in a case where the voltage $V_k$ supplied to the cathode 4 is zero and the anode voltage is $V_a$, the function f assumes a value in the range of $eV_0 \leqq u < eV_a$, not including zero, which is the same energy width as that shown in FIG. 20*b*, but the difference therebetween is caused by the existence of the control electrode 10 of this invention. Namely, $V_0$ in FIG. 20*c* is larger than $V_0$ in FIG. 20*b* and can be selected to be in an energy range not hindering the maintenance of the discharge condition according to the control electrode 10 having a voltage $V_g$. In FIG. 20*c*, the difference $V_a - V_0$ is determined to be equal to the difference $V_a - V_0$ shown in FIG. 20*b* for the easy comparison of this invention with the prior art.

Figure 20E:
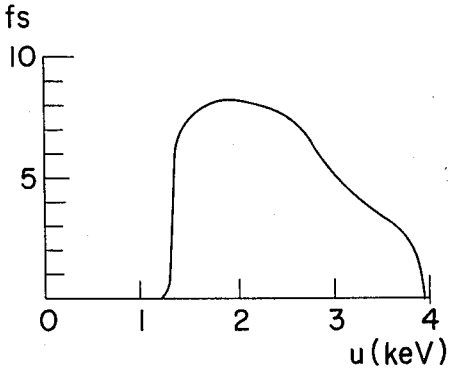

FIG. 20*e* represents a dependency of the integrand f.s of an equation $$Q = \int_{eV_0}^{eV_a} f \cdot s\, du$$

upon u in case of FIG. 20*c*. Comparison with FIG. 20*d* and FIG. 20*e*, shows that the amount of molybdenum to be sputtered can be increased by the apparatus of this invention.

As described above, the heavy ion generating apparatus shown in FIG. 18 can be operated in a range having a large sputtering ratio by controlling the energy distribution of the hydrogen ions, thus increasing the intensity of the heavy ion beam extracted. Moreover, as a current smaller than that passing through the anode passes through the control electrode, the heavy ion generating apparatus can be controlled by a small current.

In the other examples, argon gas, oxygen gas or the like can be used instead of the hydrogen gas and metals, alloys or non-metal materials can also be used instead of molybdenum. The thickness of the control electrode 10 in FIG. 18 is not limited to that described and can be selected to any desired thickness.

A further embodiment of ion generating apparatus according to this invention is shown in FIGS. 21 through 25, in which the apparatus is provided with two cathodes each provided with a through hole and with a control electrode stretched in a hollow portion of the anode in parallel with the axis thereof.

Figure 21:
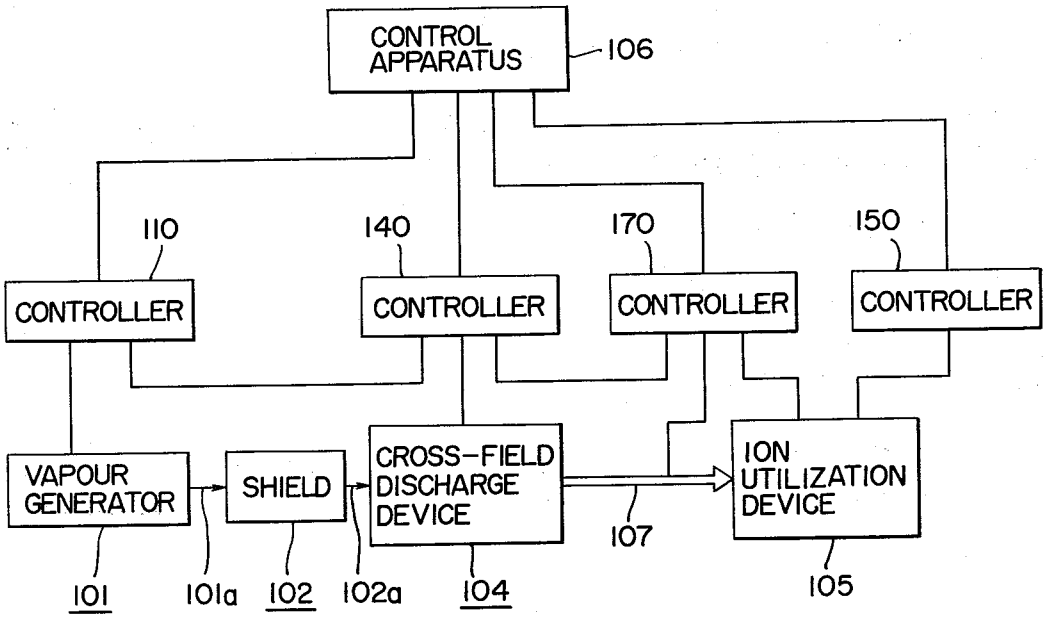
FIG. 21 is a block diagram showing an ion generating system including an ion generating apparatus of still another embodiment according to this invention.

FIG. 21 is a schematic block diagram of an entire ion generating system and its peripheral units. In FIG. 21, a part 101*a* of vapour generated from a vapour generating device 101 arrives at a shield 102 having a through hole. The vapour through this hole forms a vapour beam 102*a* which reaches the discharging area in a cross field discharge device (main body of the ion generating apparatus) 104 through a hole provided for a first cathode of the apparatus. Neutral particles are ionized and extracted as an ion beam 107 through a hole provided for a second cathode and guided to a device 105 utilizing the ion beam. The device 105, for example, is an ion accelerator, ion plating device, ion implanting device or surface analyzing device. Reference numeral 106 designates a control apparatus for supervising the control of the entire ion generating system. The vapour generating device 101 is controlled by a controller 110 and the main body of the apparatus 104 and the device 105 are controlled by controllers 140 and 150, respectively. The ion beam 107 is controlled by a controller 170. The controllers 110, 140, 150 and 170 are respectively provided with control power sources and evacuating devices as occasion demands, and are connected to the control apparatus 106 as shown in FIG. 21.

Figure 22:
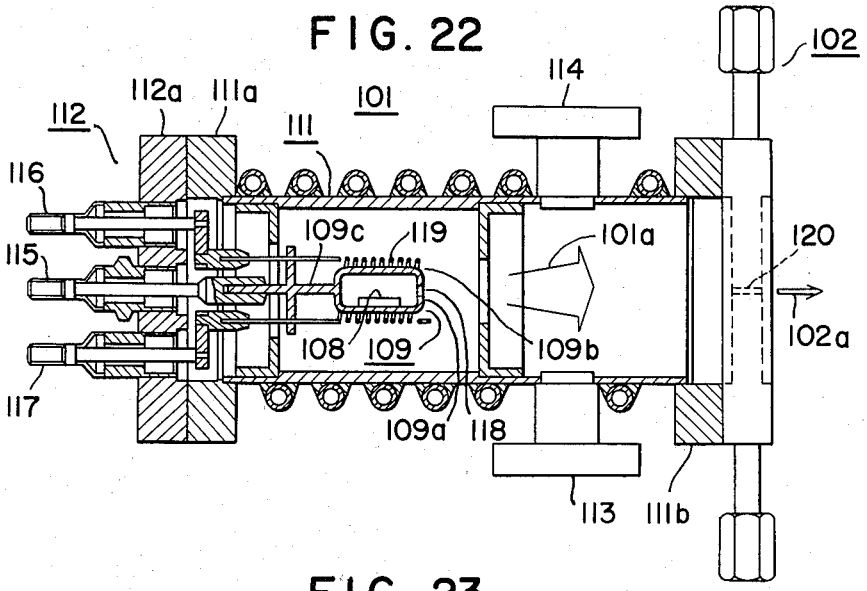
FIG. 22 shows a longitudinal section of a vapour generating device of the apparatus shown in FIG. 21.

FIG. 22 is a longitudinal sectional view of the vapour generating device 101 and the shield 102. A source material 108 for vapour in form of a solid material under a atmospheric pressure and at a room temperature is accommodated in holding means in the form of a heat resistant casing 109 made of an electroconductive material and disposed in a vacuum vessel or vacuum envelope 111. The vacuum vessel 111 having one end air-tightly sealed by a casing 112 having a flange 112*a* air-tightly secured to a flange 111*a* of the vessel 111 and having the other end air-tightly secured to the shield 102 through a flange 111*b*. The vacuum vessel 111 is further provided with flanges 113 and 114 having openings communicating with the inside of the vacuum vessel 111. The flange 113 is connected to an exhausting device, not shown, for carrying out preliminary evacuation. A monitor head of the device 101 is secured to the flange 114.

The casing 112 comprises the flange 112*a*, and feeder members 115, 116 and 117 penetrating air-tightly through the flange 112*a* and electrically insulated therefrom. The casing 109 comprises a dish like member 109*a*, a cover 109*b* and a holding rod 109*c* formed integrally with the dish like member 109*a* which is provided with an opening 118. The holding rod 109*c* is secured to the feeder member 115. An electric heater 119 is wound around the casing 109 and connected to the feeder members 116 and 117 to feed electricity. The casing 109 is highly heated by the radiation of the heater 119 and by heat caused by electron bombardment. The material 108 heated by heat transferred from the casing 109 is vapourized and the generated vapour fills the interior of the casing 109 and ejected through opening 118. A part of ejected vapour reaches the shield 102 which is cooled by a coolant flowing therethrough and provided with a through hole 120 and the vapour passing through the hole 120 forms a vapour beam 102*a* and the remaining vapour is captured by the shield 102. As the through hole 120 is fine and the shield 102 is kept at a low temperature, only a small number of particles other than the vapour beam forming particles can pass through the hole 120, thus obtaining a vapour beam having high quality.

Figure 23:
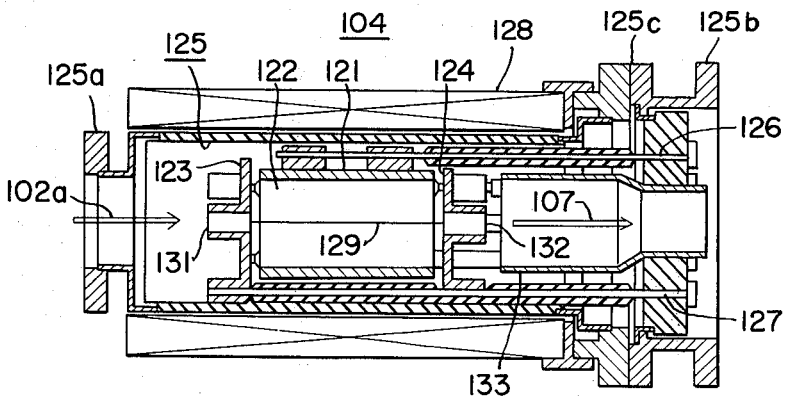
FIG. 23 shows a longitudinal section of the essential parts of the ion generating system shown in FIG. 21.

FIG. 23 shows a longitudinal sectional view of the ion generating apparatus 104. Referring to FIG. 23, the end openings of an anode 121 provided with the cylindrical inner hollow portion 122 are covered with a first and second disc-shaped cathodes 123 and 124 with gaps between the anode and the cathodes. The anode and cathodes are disposed within a vacuum vessel or vacuum envelope 125 within which the cathodes 123 and 124 are electrically connected and supported by a feeder member 127. A flange 125*a* is air-tightly connected to the shield 102 so that the vapour beam 102*a* passing through the hole 120 reaches the cathode 123. The apparatus 104 is constructed so as to align the axis of the vapour beam 102*a* with the axis of the hollow portion 122 of the anode 121.

The vacuum vessel 125 is air-tightly connected to the device 105 through a flange 125b and a flange assembly 125c constitutes a part of the vacuum vessel 125 as well as the flanges 125a and 125b and facilitates the construction of the combination of the anode 121, cathodes 123, 124 and other members in the vacuum vessel 125.

Anode voltage is supplied to the anode 121 through a feeder member 126 which supports the same and which is connected at a position between the flanges 125b and 125c to a feed line, not shown, passing through the wall of the vacuum vessel 125, and the feed line is connected to a power source. Cathode voltage is fed to the cathodes 123 and 124 through the feeder member 127 which is connected to a feed line, not shown, passing through the wall of the vacuum vessel 125 at a position between the flanges 125b and 125c, and the feed line is connected to a power source.

A permanent magnet or a super conductive or ordinary conductive electromagnet may be used as a device 128 for generating a magnetic field parallel to the axis of the hollow portion 122 therein.

A control electrode 129 is located in the hollow portion 122 in parallel with its axis and the control electrode 129 is connected to a feed line, not shown, passing through the wall of the vacuum vessel 125 at a position between the flanges 125b and 125c. The feed line is connected to an external power source, not shown.

The cathodes 123 and 124 are provided with through holes 131 and 132 respectively formed coaxially with the end openings of the anode 121.

The vapour beam 102a passing through the hole 131 enters into a discharge area defined by the anode 121 and the cathodes 123 and 124 and the neutral particles in the beam are ionized there and pass through the hole 132, thus forming an ion beam 107, which is then ejected to the outside of the cross field discharge device 104.

An electroconductive cylindrical member 133 supplied with a predetermined voltage acts as a shielding member for preventing contamination of the surroundings due to the ion beam and preventing an unexpected electric field from disturbing the trajectory of the ion beam.

Regarding supporting members for the control electrode 129, substantially the same descriptions made hereinbefore with reference to FIG. 5 is applicable with respect to their structures and operations except the fact that the second cathode 124 is also provided with a through hole 132 as well as the first cathode 123.

Figure 24:
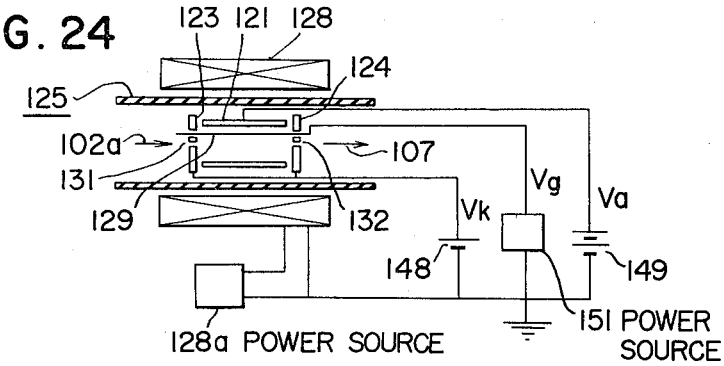
FIG. 24 shows a schematic view of a circuit for operating the ion generating apparatus shown in FIG. 21.

FIG. 24 is a block diagram showing one example of a circuit for operating the ion generating apparatus according to this embodiment, in which the magnetic field generator 128 comprises an air-core coil excited by a constant d.c. power source 128a. A zero voltage or positive voltage $V_k$ is applied by a d.c. power source 148 to the cathodes 123 and 124 which are interconnected in the vacuum vessel 125 and a positive high voltage $V_a$ is applied to the anode 121 by a high voltage d.c. power source 149. A voltage $V_g$ is applied to the control electrode 129 by a controllable power source 151 and the voltage $V_g$ controls the kinetic energy of the ion beam 107 extracted through the hole 132 of the cathode 124.

Figure 25A:
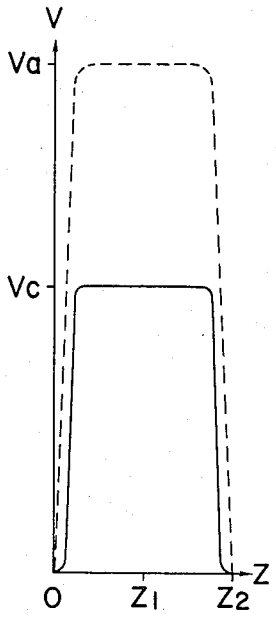
FIGS. 25*a* through 25*c* are graphs showing discharge characteristics of the ion generating apparatus shown in FIG. 21.
Figure 25B:
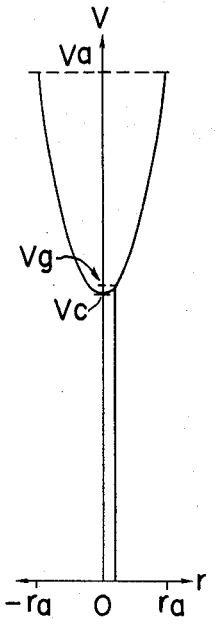
Figure 25C:
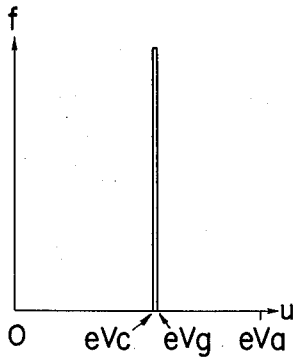

FIGS. 25a through 25c represent discharge characteristic of the apparatus of this embodiment shown in FIG. 23 and correspond to FIGS. 7a through 7g used for explaining the other embodiments of this invention.

In order to obtain a current $I_a$ passing through the anode 121 which is the same as that shown in FIG. 6b, the voltage $V_a$ of the anode 121 of the cross field discharge apparatus has to be higher than that of the anode 1 of a prior art PIG type apparatus shown in FIG. 1. It is necessary to set the voltage $V_g$ of the control electrode 129 to a value higher than the voltage $V_k(=0)$ of the cathode by more than 100 V, preferably 300 V.

If the voltages $V_a$, $V_g$ and the strength of the magnetic field are kept to proper values, the discharge of the cross field discharge device is stabilized and the space voltage distribution is shown in FIGS. 25a and 25b by which it is understood that a voltage $V_c$ at a portion on the central axis of the hollow portion 122 between the cathodes 123 and 124 assumes a value near the voltage $V_g$.

In a case where the anode voltage $V_a$ and the strength of the magnetic field are predetermined, the voltage $V_c$ is determined by the voltage $V_g$ of the control electrode 129 and not appreciably affected by the cathode voltage $V_k$. This fact means that the control electrode 129 can control the cross field discharge and the cathode does not control the dicharge, but merely maintains its voltage at $V_k \leqq V_g - 100$ V to maintain the discharge and the adverse effects of the through holes of both cathodes on the cross field discharge are avoided by the use of the control electrode. Energy distribution of the ion beam extracted through the hole 132 is shown in FIG. 25c which has a narrow energy range.

Figure 26A:
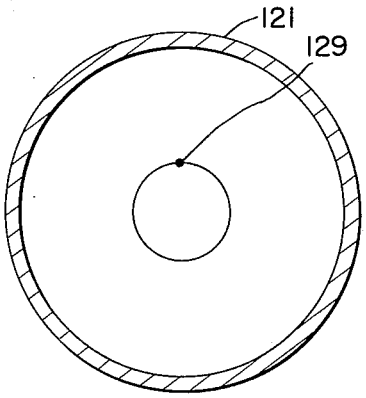
FIGS. 26*a* through 26*c* are cross sectional views of the hollow portions of the anodes showing examples according to the apparatus shown in FIG. 23.
Figure 26B:
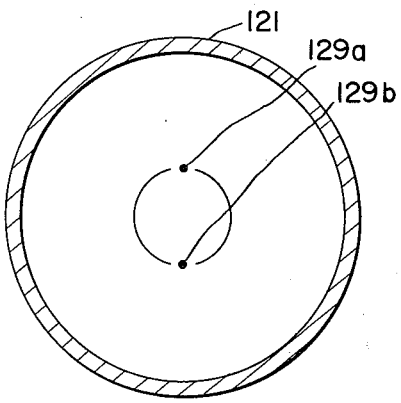
Figure 26C:
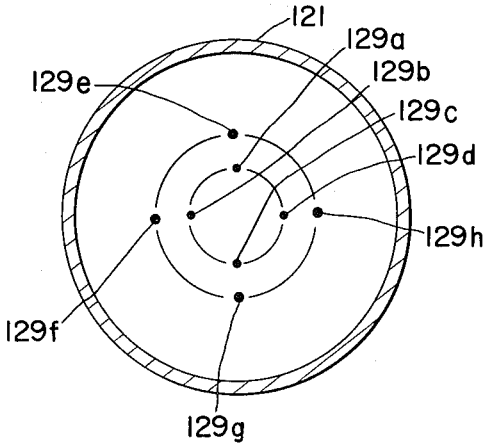

As illustrated in FIGS. 26a through 26c, a plurality of control electrodes may be disposed in the hollow portion of the anode. In FIG. 26b, two electroconductive wires 129a and 129b are disposed to act as control electrodes which are symmetrical with respect to the central axis of the hollow portion 122, and with this example, the symmetry of the space voltage and the orientation of the ion beam are improved in comparison with the example shown in FIG. 26a. FIG. 26c shows the other example, in which a first assembly of four electroconductive wires 129a through 129d and a second assembly of four electroconductive fine tubes 129e through 129h are arranged to act as control electrodes in positions as shown in FIG. 26c. By arranging the first assembly of the control electrodes in a manner described above, the orientation of the ion beam can be improved and the expansion thereof can be suitably suppressed in comparison with the cases shown in FIGS. 26a and 26b. The arrangement of the second assembly of the control electrodes can increase a current of the ion beam extracted and reduce the impurity ions entrained in the ion beam.

In the embodiment described above with reference to FIGS. 21 through 26c, any two among the vapour generating material 108, the casing 109, and the heater 119 may be made of the same material and the heater 119 can be constructed so that the vapour of the heater 119 may be utilized as a vapour 101a in FIG. 22.

Figure 27:
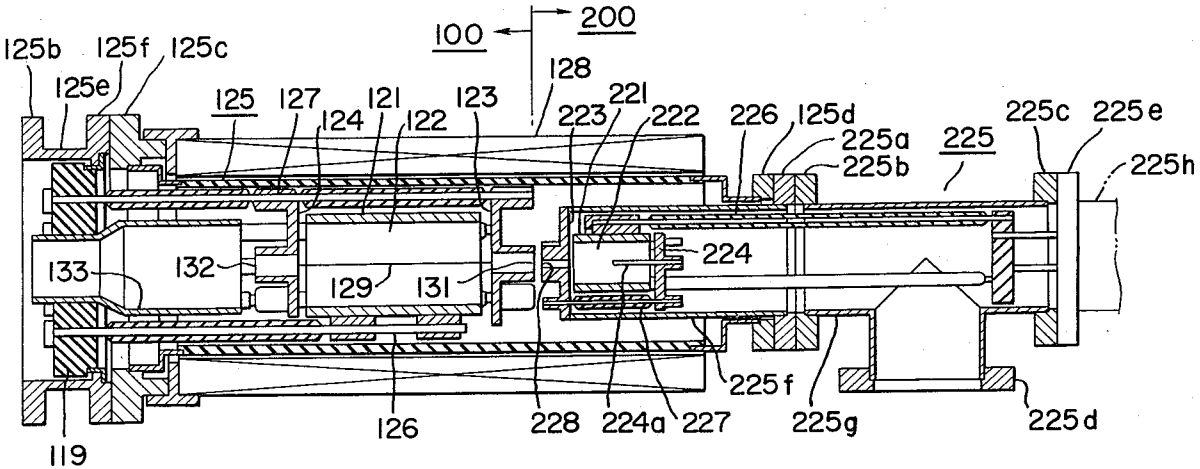
FIG. 27 shows a longitudinal section of still another embodiment of the ion generating apparatus according to this invention.

FIG. 27 shows a still further embodiment of a heavy ion generating apparatus according to the invention, which is an improvement of the embodiments shown in FIGS. 18 and 23 for further decreasing impurities in the ion beam and obtaining high ion current in a case where the apparatus is operated at the same electric powers. The ion generating apparatus of this embodiment generally comprises first and second cross field discharge devices 100 and 200. The construction of the first cross field discharge device 100, the principal element of this ion generating apparatus, is substantially the same as that shown in FIG. 23 except that the magnetic field generator 128 is common to the first and the second cross field discharge devices 100 and 200. The second discharge device 200 comprises an anode 221, a pair of cathodes 223 and 224 which close with gaps the end openings of the anode 221, electroconductive feeder members 226 and 227, and a vacuum vessel 225 enclosing the elements described above. The cathode 223 is provided with a through hole 228 facing the hole 131 of the cathode 123 of the first discharge device 100 and having the axis common to that of the hole 131 and that of the hollow portion 222 of the anode 221. An ion generation material 224*a* is mounted on the cathode 224.

Flanges 225*a* and 225*b* are integrally assembled and secured to the flange 125*d* of the vacuum vessel 125 and the flange 225*a* is air-tightly secured to a casing 225*f* to keep air tightness of the second discharge device 200. The flange 225*b* is air-tightly connected to a T-shaped member 225*g* having other two openings air-tightly secured to the flanges 225*c* and 225*d*. The flange 225*c* is air-tightly secured to an anode holder 225*h* through a flange 225*e* and the anode holder 225*h* is provided with a feed line for feeding electricity to the anode 221 through the feeder member 226 supporting the same.

The flange 225*d* is connected to a known evacuating device 230 (FIG. 28) provided with gas exhausting means with a small capacity of exhausting air from the vacuum vessel 225 and supplying working gas for the discharge. The cathodes 223 and 224 are connected by a supporting member constituting the feeder member 227 which is a part of a feed line including the casing 225*f* and the flange 225*a*.

The ion generation material 224*a* is a rod shaped material in a solid state under a room temperature which has an axis common to that of the hollow portion 222 and is disposed with a space between its front end and the cathode 223. To the space defined by the anode 221 and the cathodes 223 and 224 is applied a discharge voltage by an external power source, not shown. As the second cross field discharge device 200 is arranged within a magnetic field created by the magnetic field generator 128, it may be said that the type of the discharge in the discharge device 200 is of an intermediate type of a PIG-type discharge and a magnetron discharge.

Referring to the first cross field discharge device 100, the supporting members constituting the feeder members 126 and 127 for the anode 121 and the cathodes 123 and 124 are secured by a common connecting member at their one ends, and the other ends thereof are secured to an insulating support member 119 inside a pipe 125*e*. The pipe 125*e*, both ends of which are secured to the flanges 125*b* and 125*f*, is provided with a feed line, not shown, penetrating its wall to supply operating voltage to a control electrode 129 stretched across the inner hollow portion 122 of the anode 121 and cathodes 123 and 124. The control electrode 129 is supported by supporting members, not shown, and electrically insulated from the anode and the cathodes in a manner identical to that described hereinbefore with respect to the other embodiments.

Figure 28:
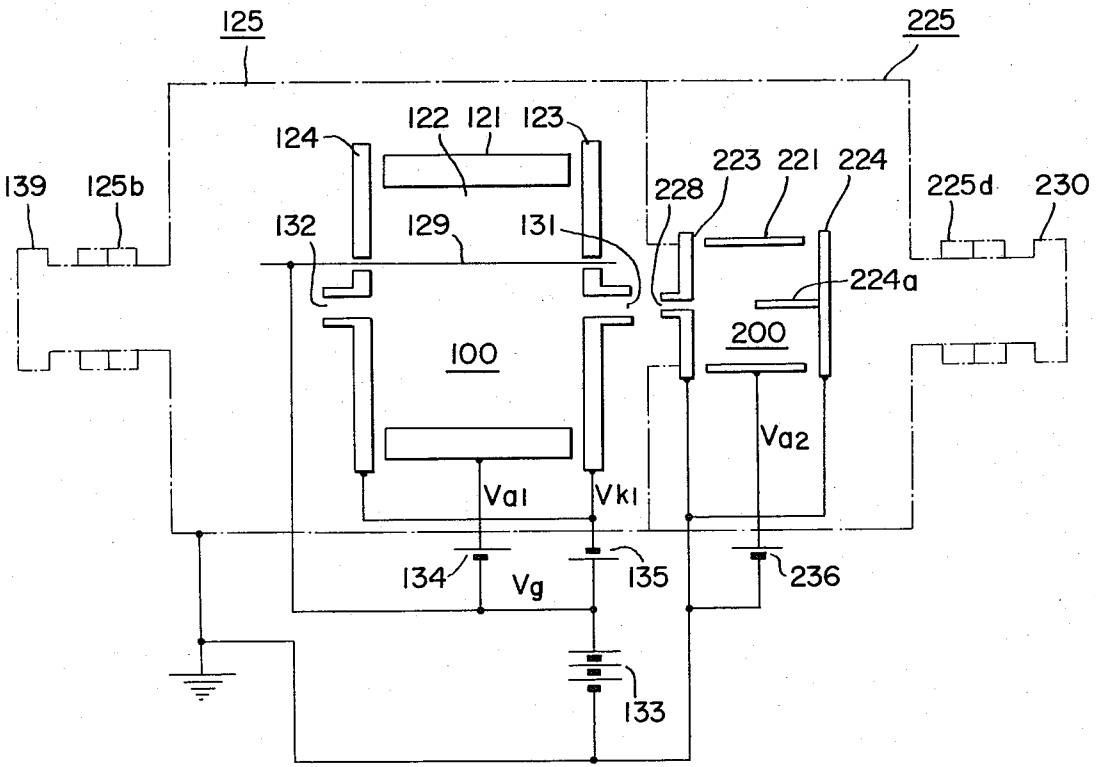
FIG. 28 shows a block diagram of the apparatus shown in FIG. 27 including evacuating devices and a circuit for operating the apparatus.

FIG. 28 is a block diagram of the ion generating apparatus shown in FIG. 27 for operating the same and in FIG. 28 solid lines represent a circuit for a power source system and dash and dot lines represent a vacuum system. Regarding the vacuum system, the vacuum vessel 125 is air-tightly secured to an evacuating device 139 through the flange 125*b* and the other vacuum vessel or vacuum envelope 225 connected to the vacuum vessel 125 is connected through the flange 225*d* to an evacuating device 230 having suitable exhausting means. The vacuum vessel 125 is communicated with the vacuum vessel 225 only through the hole 228 provided for the cathode 223 and is partitioned therefrom by a partition wall at the other portions.

After the ion generating apparatus (100;200) has been assembled, the apparatus is secured to the evacuating device 139 and then to the evacuating device 230. The vacuum vessels 125 and 225 are exhausted mainly by the exhausting means contained in the evacuating devices 139 and 230, respectively. After the vacuum vessels have been evacuated to a predetermined degree of vacuum, the ion generating apparatus is operated and the cross field discharge is established in the magnetic field caused by the magnetic field generator 128 for removing the gas adsorbed on the surfaces of the cross field discharge devices 100 and 200 by carrying out discharge cleaning. For example, a shutter mechanism may be provided for preventing the discharge of heavy ions through the hole 132 during the discharge cleaning, thus preventing the passing of the ion beam into the evacuating device 139. Usually, this discharge cleaning is completed for about ten minutes if a suitable discharge device is used and a working gas is introduced from the evacuating device 230.

Regarding the circuit of the power system shown in FIG. 28, an output voltage $V_g$ of a d.c. power source 133 is applied to the control electrode 129 of the first cross field discharge device 100, a voltage $V_{a1}$ is applied to the anode 121 by d.c. power sources 133 and 134, and a voltage $V_{k1}$ is also applied to the cathodes 123 and 124 by d.c. power sources 133 and 135. The cathodes 223 and 224 of the second cross field discharge device 200 are grounded together with the vacuum vessels 125 and 225, and a voltage $V_{a2}$ is applied to the anode 221 by a d.c. power source 236. It is desired to use variable power sources as the power sources 134 and 236 for carrying out the discharge cleaning thereby purifying outputted ion beam.

In the arrangement shown in FIG. 28, a working gas such as argon is first admitted into the evacuating device 230 and then exhausted thereby to maintain dynamic equivalency of gas pressure and gas flow in the evacuating device 230. Thus, the working gas pressure in the vacuum vessel 225 communicating whith the discharge area of the second discharge device 200 can be controlled by the evacuating device 230. Ionized ions of the working gas in the discharge device 200 are accelerated and collide with the material 224*a* attached to the cathode 224 thereby to eject heavy neutral particles due to the sputtering from the material 224*a* into the space therearound. The sputtering is particularly violently observed near the front end of the material 224*a*, and a distance between the front end of the material 224*a* and the hole 228 of the cathode 223 is determined, so that a large amount of particles ejected from the material 224*a* reaches the hole 228. Most of the particles passing through the hole 228 travel into the first discharge device 100 through the hole 131 of the cathode 123.

Within the discharge space defined by the anode 121 and the cathodes 123 and 124, since swarm of electrons having high energies and high densities exist, neutral particles moving in this space are ionized during a short travel therein and the generated ions are guided by an electromagnetic field towards the cathode 124. Ions arriving at the cathode 124 are extracted as an ion beam into the evacuating device 139 through the hole 132.

With a prior art PIG-type discharge device having two cathodes provided with through holes at portions corresponding to the central portion of the end openings of an anode, a discharge obtained was unstable for the reason that the position having the lowest space voltage in the discharge field is near the central axis of the inner hollow portion of the anode and no cathode plane for determining the cathode drop exists there. On the other hand, in a case where a control electrode (129 in FIG. 28) is disposed, when the voltage $V_g$ is higher than the voltage $V_{k1}$ by a predetermined voltage (for example, 600 V), the control electrode 129 affects electron swarm in the discharge portion and controls the density and energy of the electrons as well as the space voltage, thus effectively maintaining stable discharge even if through holes 131 and 132 are provided for the cathodes 123 and 124, respectively.

Moreover, as the through hole 228 has a fine and relatively long inner passage, the conductance thereof is very low and as the pressure of the working gas in the second discharge device 200 is considerably low, the amount of the working gas flowing from the vacuum vessel 225 to the vacuum vessel 125 is highly reduced. In addition, as the ions of the working gas passing through the hole 228 are reflected by a high space potential near the central axis of the hollow portion 122, working gas ions as impurity ions are highly reduced.

With the embodiments described hereinbefore, an ion generating apparatus is provided with a control electrode stretched across the hollow portion of an anode between a pair of cathodes, but the embodiment may include a case where a control electrode extends longitudinally from one of the cathodes and does not reach the other cathode.

It should be understood by those skilled in the art that the foregoing descriptions relate to some preferred embodiments of the ion generating apparatus and that various changes and modifications may be made without departing from the spirit and scope thereof.

I claim:

1. In an ion generating apparatus of the type comprising a cylindrical vacuum envelope, an anode disposed in said vacuum envelope and provided with a tubular inner hollow portion, a pair of cathodes disposed in said vacuum envelope near both end openings of said anode so as to cover said end openings, means for applying a voltage between said anode and said cathode to creat an electric field in said hollow portion, means for creating a magnetic field in said hollow portion in a direction parallel to a central axis of said hollow portion, means for supplying working gas into said hollow portion to establish a cross field discharge, and an evacuating device for creating a predetermined vacuum condition in said vacuum envelope, at least one of said cathodes being provided with a through hole at a central portion thereof, the improvement in which a control electrode is stretched in said hollow portion in parallel spaced relation with respect to the central axis of said hollow portion.

2. The apparatus according to claim 1 wherein said control electrode is supported by supporting members at positions outside said respective cathodes and is electrically insulated from said anode and said cathodes.

3. The apparatus according to claim 2 wherein an ion extraction hollow cylindrical electrode is provided near the through hole of one of said paired cathodes so as to coincide with the axis of said ion extraction electrode and the axis of said through hole, said ion extraction electrode extending beyond the front end of said electrode supporting member from the outer surface of said one of cathodes and having a longitudinal length three times longer than the inner radius of said ion extraction electrode.

4. The apparatus according to claim 3 wherein said ion extraction hollow cylindrical electrode is formed integrally with said through hole of said one of the cathodes.

5. The apparatus according to claim 1 wherein said tubular hollow portion is cylindrical.

6. The apparatus according to claim 1 wherein said tubular hollow portion is polygonal.

7. The apparatus according to claim 1 wherein a plurality of said hollow portions are provided within said anode.

8. The apparatus according to claim 1 wherein a plurality of members each having a hollow portion in which an electrode extends parallelly with the axis of said hollow portion are bundled and disposed in one magnetic field.

9. The apparatus according to claim 1 wherein said control electrode has a thickness satisfying the following equation:

$$x \leqq k.R/L(k=10^{-3}m)$$

in which $x_{(m)}$ designates a maximum distance from the longitudinal axis of said control electrode to the surface thereof; $R_{(m)}$ is a distance between the axes of said control electrode and said hollow portion; and $L_{(m)}$ is a distance between said paired cathodes.

10. The apparatus according to claim 1 wherein said control electrode is made up by a plurality of elemental electrodes which satisfy the following equation:

$$\sum_{n=1}^{m} \frac{N_n X_n}{R_n} \geqq k \cdot \frac{4}{L} \ (k = 10^{-3}\text{m})$$

in which n: an assembly number of said elemental electrodes which are positioned at portions apart by the same distance from the central axis of said hollow portion of said anode, $N_n$: total numbers of said elemental electrodes belonging to the assembly number n, $R_{n(m)}$: distance between the axis of said hollow portion and the axis of one elemental electrode belonging to the assembly number n, $X_{n(m)}$: distance obtained by the steps of calculating an average distance of the distances from the central axis of said elemental electrode to the surface thereof throughout the entire length of each elemental electrode and then calculating an average distance of average distances calculated as above described of the all elemental electrodes of the assembly number n, $L_{(m)}$: distance between the surfaces of said cathodes measured along a line parallel to the axis of said hollow portion of said anode, and m: number of the whole assembly numbers.

11. The apparatus according to claim 10 wherein the total number of said elemental control electrodes equals 1.

12. The apparatus according to claim 10 wherein a few of said elemental electrodes are constructed as fluid passing pipes for cooling.

13. The apparatus according to claim 1 wherein a partition wall is disposed in said vacuum envelope so as to separate a cross field discharge area defined by said anode and said cathodes and exhausting means of said evacuating device so that gas flows only through said hole provided for said one of said paired cathodes and a vacuum conductance of gas flow area of said hole becomes far larger than a vacuum conductance at the other portion.

14. The apparatus according to claim 13 which further comprises means for changing said vacuum conductance.

15. The apparatus according to claim 13 or 14 which further comprises means for supplying a working gas into a space defined by said one of said paired cathodes.

16. The apparatus according to claim 14 wherein said working gas is supplied to said other one of said paired cathodes.

17. The apparatus according to claim 14 wherein said working gas is supplied to said anode.

18. The apparatus according to claim 14 wherein said working gas is supplied to said control electrode.

19. The apparatus according to claim 1 wherein the other one of said paired cathodes is provided on the surface facing said anode with a material which is solid at a room temperature for emitting particles to be ionized at a position facing the through hole of said one of the cathodes, said paired cathodes being interconnected in said vacuum envelope.

20. The apparatus according to claim 1 wherein the other one of said paired cathodes is provided with a material which is solid at a room temperature for emitting particles to be ionized at a position facing the through hole of said one of the cathodes, said paired cathodes being electrically connected through a feed line including a circuit element.

21. The apparatus according to claim 1 wherein the other one of said paired cathodes is provided with a material which is solid at a room temperature for emitting particles to be ionized at a position facing the through hole of said one of the cathodes, said paired cathodes being electrically insulated and connected independently to feed members passing through a wall of said vacuum vessel.

22. The apparatus according to claim 1 wherein the other one of said paired cathodes is also provided with a through hole on its surface at a portion facing said through hole of said one of said paired cathodes.

23. The apparatus according to claim 22 which further comprises vapour generating means comprising evaporating material, an evaporating material holder, and a heater, vapour of said evaporating material heated by said heater being admitted into a discharge space defined by said anode and said cathodes through the hole provided for said other one of paired cathodes and ions generated by said cross field discharge being ejected outwardly of said dischrge space through the hole provided for said the one of said paired cathodes.

24. The apparatus according to claim 22 wherein a plurality of said control electrodes are disposed within said inner hollow portion of said anode at symmetric positions about the axis of said hollow portion.

25. The apparatus according to claim 22 which further comprises a cross field discharge device arranged coaxially with said vacuum envelope and within a magnetic field generated by said magnetic field generating means, said cross field discharge device comprising a further cylindrical vacuum envelope coaxial with said first mentioned vacuum envelope, a further anode disposed in said further vacuum envelope coaxially therewith and provided with an inner hollow portion, a further pair of cathodes disposed in said further vacuum envelope so as to cover both end openings of said further anode, and feeder means for applying voltages to said further anode and said further cathodes and for supporting the same, one of said further paired cathodes being provided with a through hole at a portion corresponding to the central portion of one end opening of said further anode, the other one of said further pair cathodes being provided with an ion generation member in solid state at a room temperature at a portion corresponding to the central portion of the other one end opening of said further anode, said cross field discharge device being connected to a further evacuating device.

26. The apparatus according to claim 25 wherein said further vacuum envelope is integrally constructed with said first mentioned vacuum envelope, said integral vacuum envelope being provided with a partition wall for partitioning said cross field discharge device and the other parts of the apparatus, said partition wall being provided with a through hole, the central axis of which coincides with axes of the hollow portions of said first mentioned anode and said further anode.

27. The apparatus according to claim 25 wherein said first mentioned vacuum envelope and said further vacuum envelope are connected through a flange, at least one of said vacuum envelopes is provided with a partition wall for partitioning said cross field discharge device and the other parts of the apparatus, said partition wall being provided with a through hole, the central axis of which coincides with axes of the hollow portions of said first mentioned anode and said further anode.

28. The apparatus according to claim 27 wherein said partition wall disposed in said further vacuum envelope of said cross field discharge device is constructed by said one of said further paired cathodes.

29. The apparatus according to claim 20, 21, 22 or 23 wherein an ion generation member is integrally embedded in said the other one of said further paired cathodes so as to form a flat inner surface thereof.

30. The apparatus according to claim 25, 26, 27 or 28 wherein said ion generation member is constructed by a rod member on the surface of which an ion generation material is applied, the front end of said rod member being separated from said one of said further paired cathodes on the central axis of the hollow portion of said further anode.

* * * * *